US006379212B1

(12) United States Patent
Miller

(10) Patent No.: US 6,379,212 B1
(45) Date of Patent: Apr. 30, 2002

(54) SYSTEM AND SET OF INTERCLEAVING DICHOTOMIZED POLYHEDRAL ELEMENTS AND EXTENSIONS

(76) Inventor: George R. Miller, 11630 Southern Maryland Blvd., Dunkirk, MD (US) 20754

( * ) Notice: Subject to any disclaimer, the term of this patent is extended or adjusted under 35 U.S.C. 154(b) by 0 days.

(21) Appl. No.: 09/266,010

(22) Filed: Mar. 11, 1999

Related U.S. Application Data

(60) Provisional application No. 60/077,908, filed on Mar. 13, 1998, and provisional application No. 60/092,842, filed on Jul. 14, 1998.

(51) Int. Cl.[7] ..... A63H 33/04
(52) U.S. Cl. ..... 446/85; 124/487
(58) Field of Search ..... 446/85, 101, 124, 446/125, 126, 108, 487, 116

(56) References Cited

U.S. PATENT DOCUMENTS

| | | | | |
|---|---|---|---|---|
| 2,151,066 A | | 3/1939 | Anderson | |
| 2,549,189 A | | 4/1951 | Gabo | |
| 2,633,662 A | | 4/1953 | Nelson | |
| 2,709,318 A | | 5/1955 | Banjamin | |
| 2,848,769 A | | 8/1958 | Oakley | |
| D213,709 S | | 4/1969 | Gale | |
| 3,510,962 A | | 5/1970 | Kazuhisa Sato | |
| 3,564,758 A | | 2/1971 | Willis | |
| 3,568,381 A | | 3/1971 | Hale | |
| 3,597,874 A | | 8/1971 | Ogsbury | |
| 3,800,556 A | | 4/1974 | Duerkson | |
| 3,950,888 A | | 4/1976 | Hogan | |
| 4,026,087 A | | 5/1977 | White | |
| 4,051,621 A | | 10/1977 | Hogan | |
| 4,079,541 A | | 3/1978 | Hogan | |
| 4,207,715 A | | 6/1980 | Kitrick | |
| 4,271,628 A | | 6/1981 | Barlow | |
| 4,719,726 A | | 1/1988 | Bergman | |
| 5,046,988 A | * | 9/1991 | Bennett | 446/487 |
| 5,448,868 A | | 9/1995 | Lalvani | |

(List continued on next page.)

FOREIGN PATENT DOCUMENTS

| | | |
|---|---|---|
| CH | 245402 | 7/1946 |
| CH | 266913 | 5/1970 |
| DE | 35336996 A1 | 10/1985 |

*Primary Examiner*—Sam Rimell
(74) *Attorney, Agent, or Firm*—Jones, Tullar & Cooper, P.C.

(57) ABSTRACT

The invention is a system and set of intercleaving (interfitting and adhering/clinging) toy or real construction elements which may be implemented in either a physical or virtual reality. These construction elements may be used as structural elements, construction components, building blocks, modeling elements, or the like. Each of these discrete structural elements is comprised of a plurality of pyramids, or other polyhedral members, clustered around at least one central point in such a manner that the resulting cluster or clusters form a discrete structural element. The polyhedral members may be joined at least partially along coincident edges for maintaining the structural stability of the element. A portion of the joining coincident edges of the polyhedral members are slotted or not completely joined ("difurcated") on the outer half of the joining edge to facilitate interfitting of a first element with a second element. Accordingly, each element of the invention has the ability to be intermitted with other complimentary elements in a mutually interfitting and adhering manner along the coincident edges of sets of diagonally adjacent polyhedral members which have been diflicated along an outermost portion of their coincident edges which radiate from their coincident central point. These generally polyhedral construction elements may also be projected/truncated into the form of spheres or other ellipsoidal construction elements while retaining their intercleavinig properties.

20 Claims, 17 Drawing Sheets

U.S. PATENT DOCUMENTS 5,489,230 A * 2/1996 Gavula, Jr. ..... 446/124
5,553,967 A 9/1996 Uozumi
5,567,194 A * 10/1996 Stapleton ..... 446/124
5,617,691 A 4/1997 Yamamota
5,906,530 A * 5/1999 Lindsey ..... 446/85
6,059,631 A * 5/2000 Maddock ..... 446/126

* cited by examiner

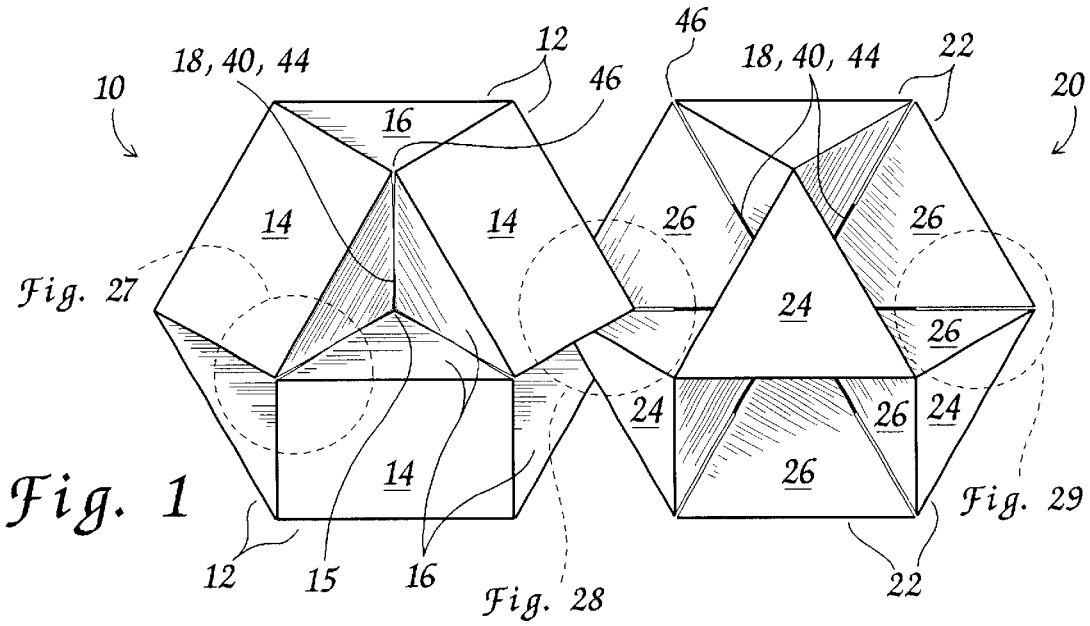
Fig. 1
Fig. 28
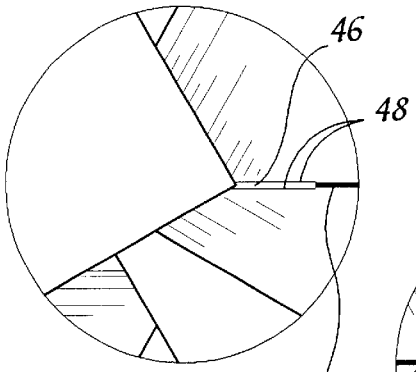
Fig. 27
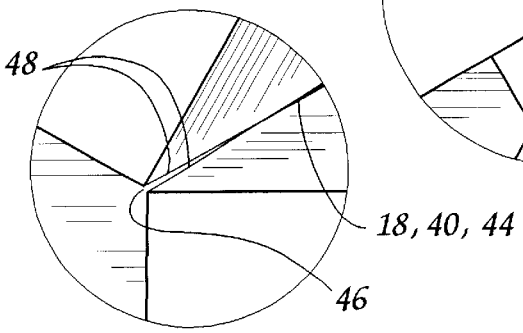
Fig. 29
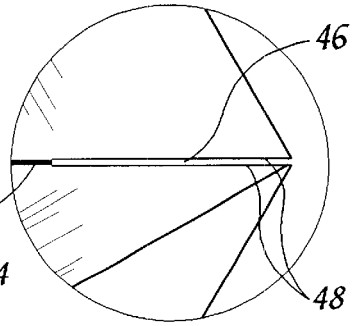

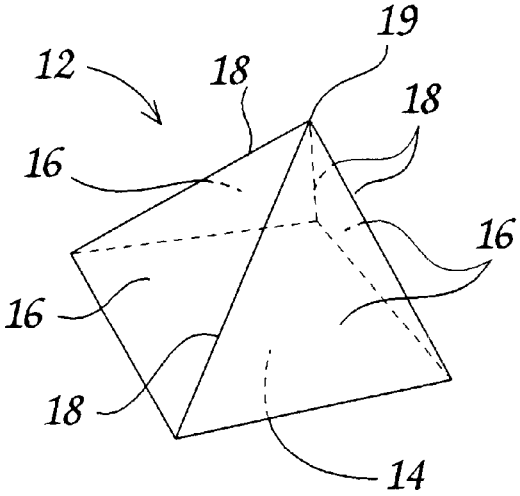
Fig. 2
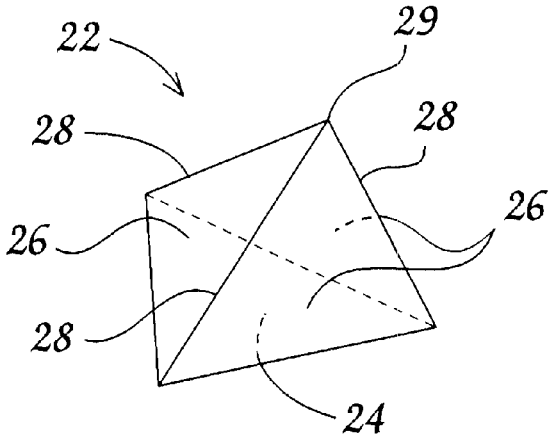
Fig. 3
Fig. 15a
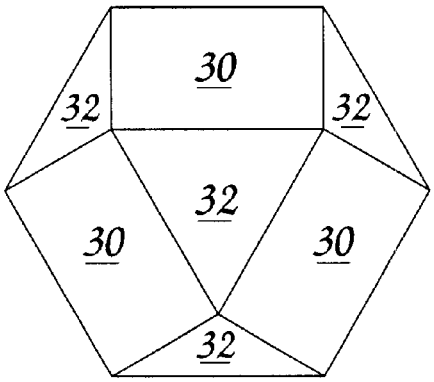
Fig. 15b
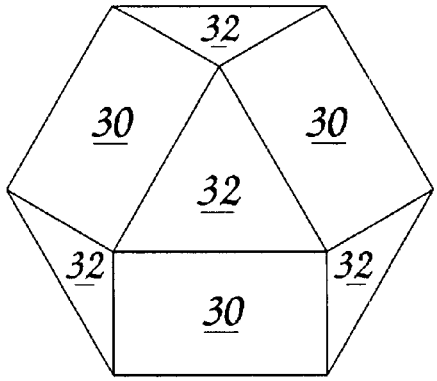

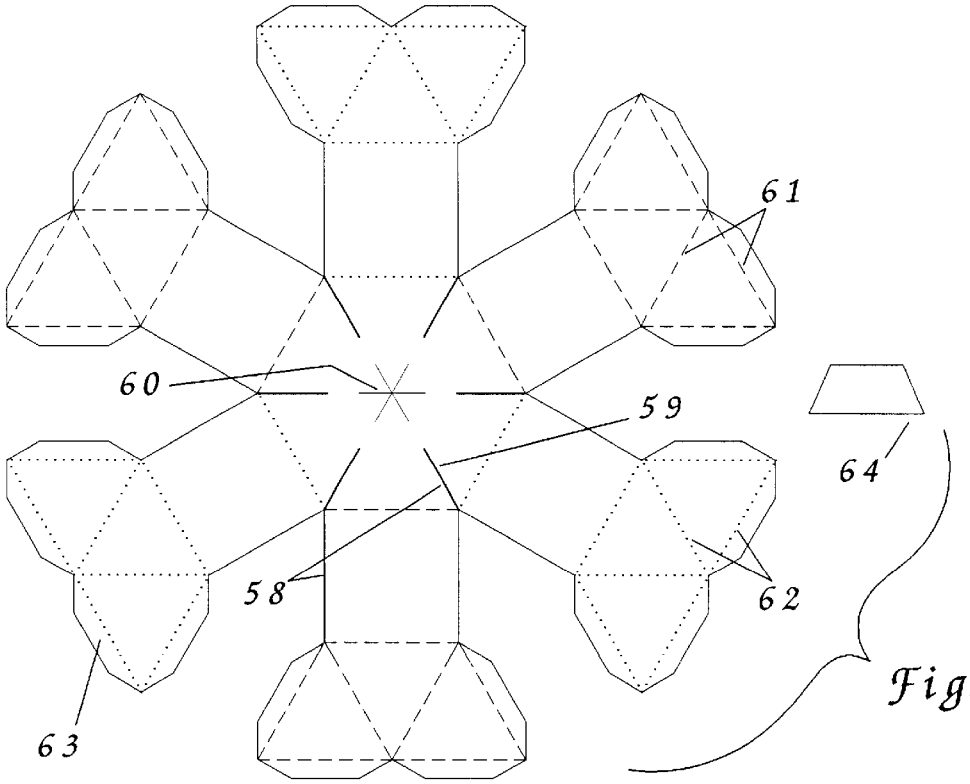
Fig. 35
Fig. 36
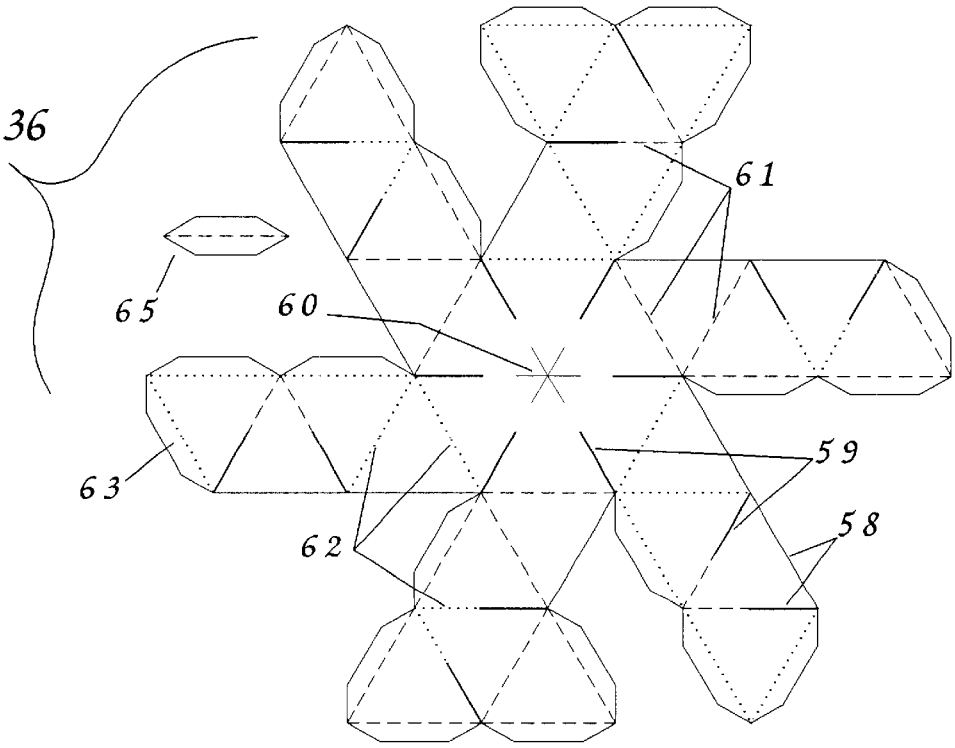

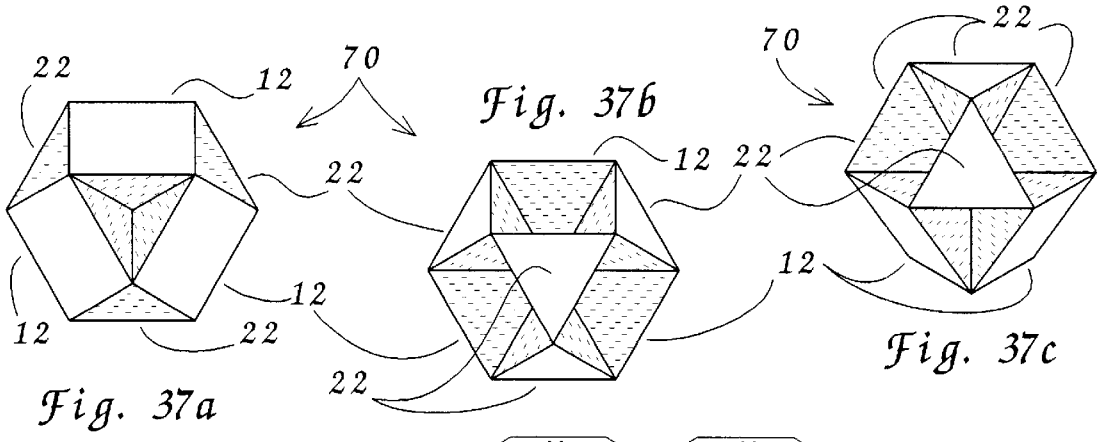
22
12
70
22
12
22
12
Fig. 37b
12
22
70
22
12
Fig. 37c
Fig. 37a
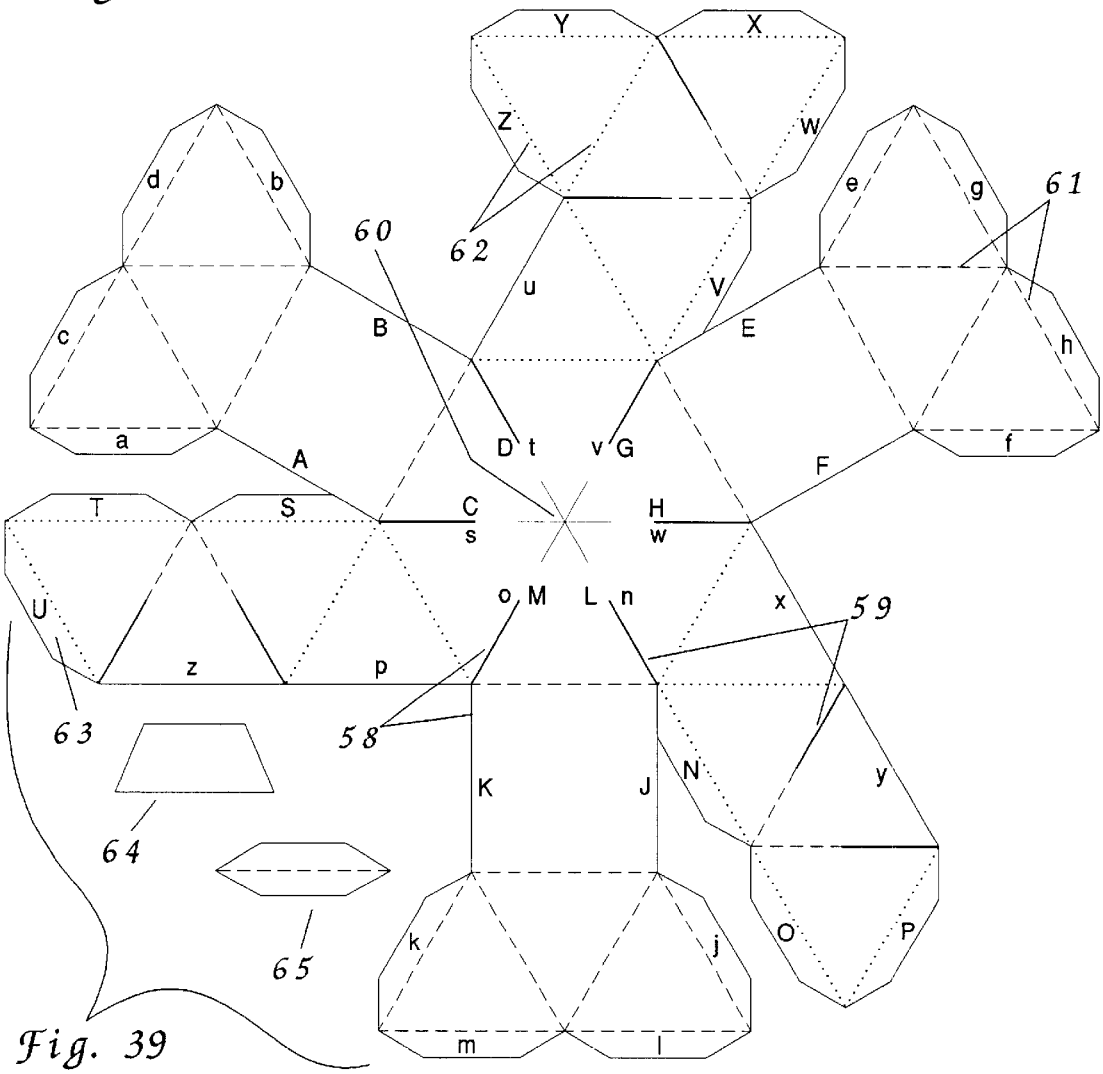
Y
X
Z
W
d
b
e
g
61
60
62
u
V
c
B
E
h
a
A
D
t
v
G
f
F
T
S
C
s
H
w
U
o
M
L
n
x
59
z
p
63
58
K
J
N
y
64
65
k
j
O
P
m
l
Fig. 39

Fig. 44
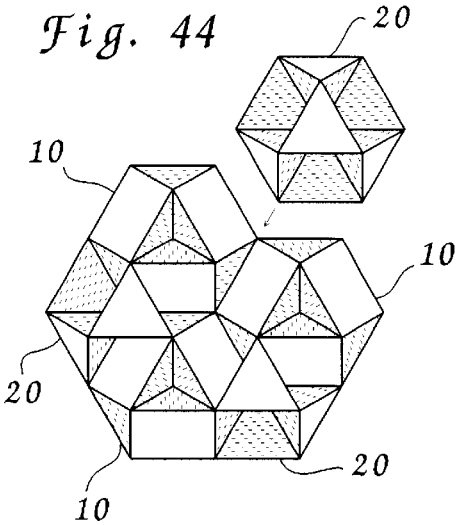
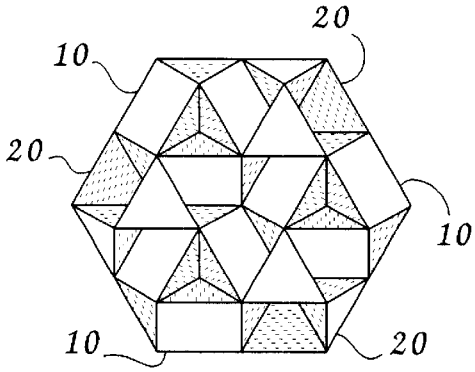
Fig. 45a
Fig. 45b
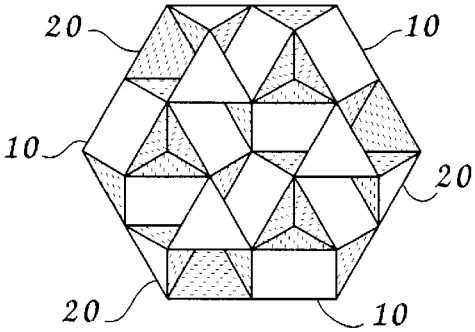
Fig. 46
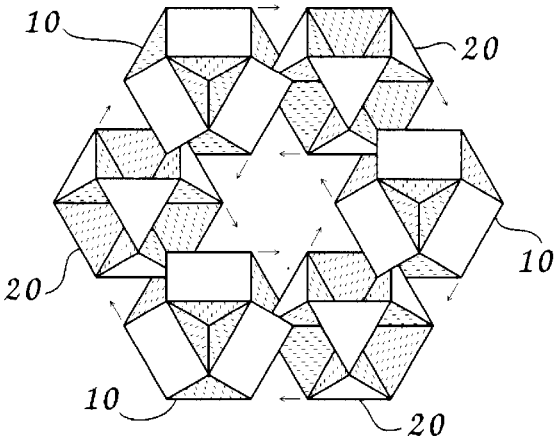
Fig. 47
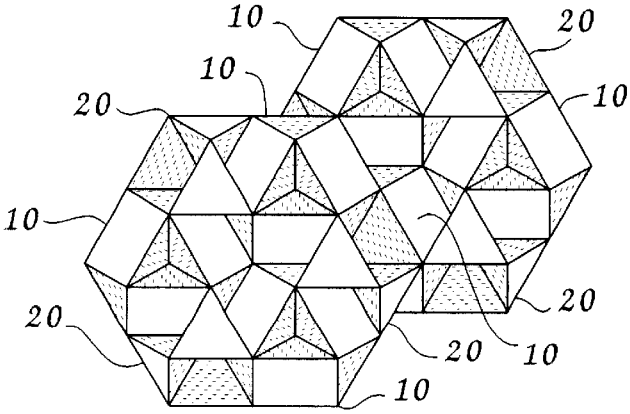

Fig. 54a
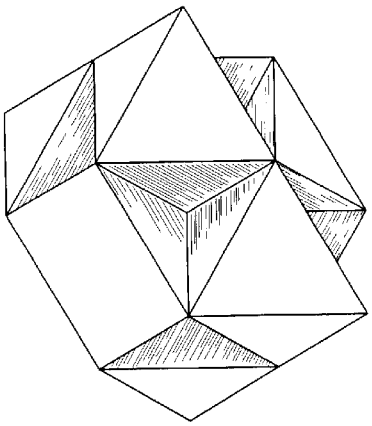
Fig. 54b
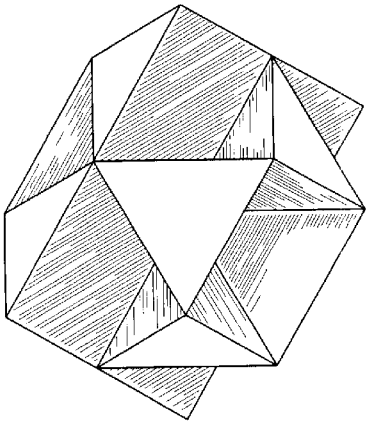
Fig. 56a
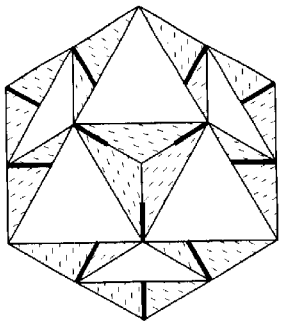
Fig. 56b
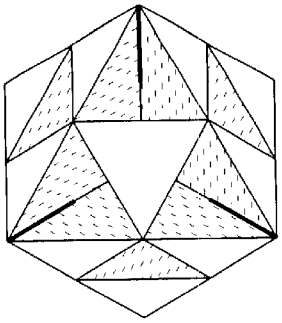
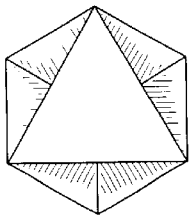
Fig. 55

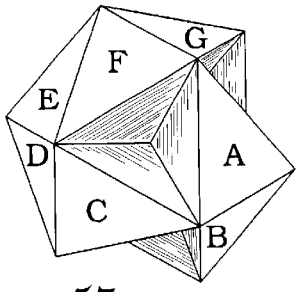
Fig. 57a
Fig. 57b
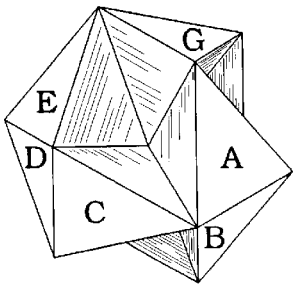
Fig. 57c
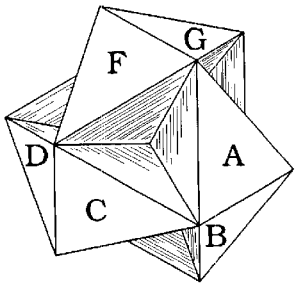
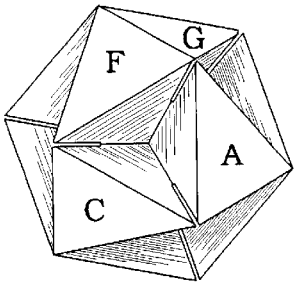
Fig. 57d
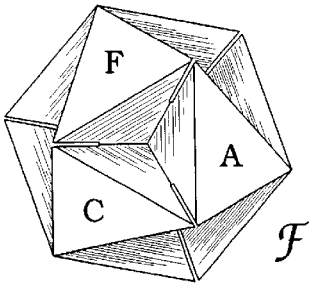
Fig. 57e
Fig. 58a
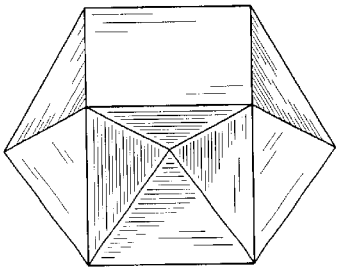
Fig. 58b
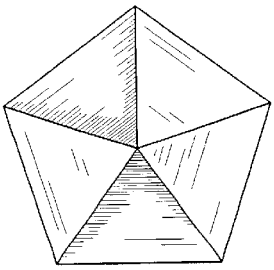
Fig. 58c
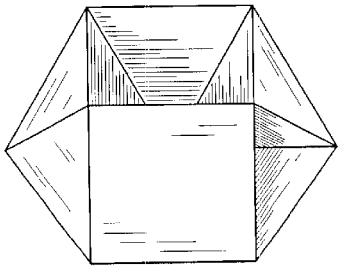

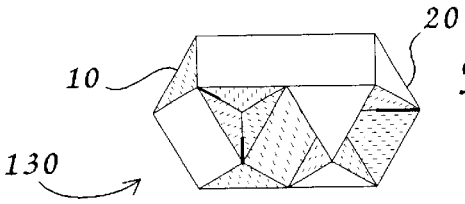
Fig. 63b
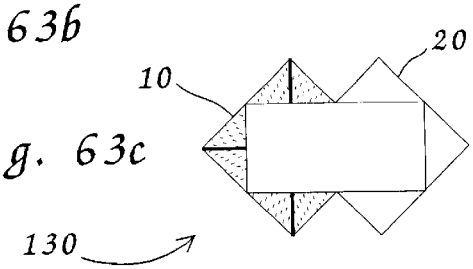
Fig. 63c
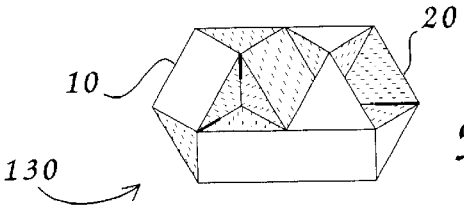
Fig. 63a
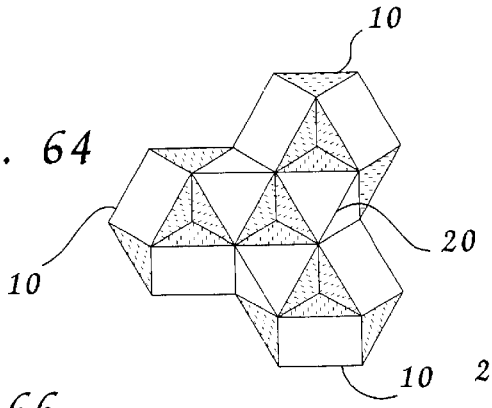
Fig. 64
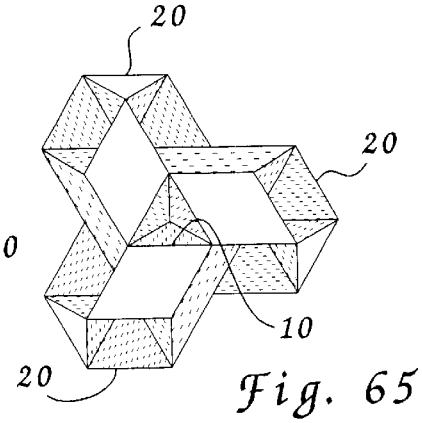
Fig. 65
Fig. 66
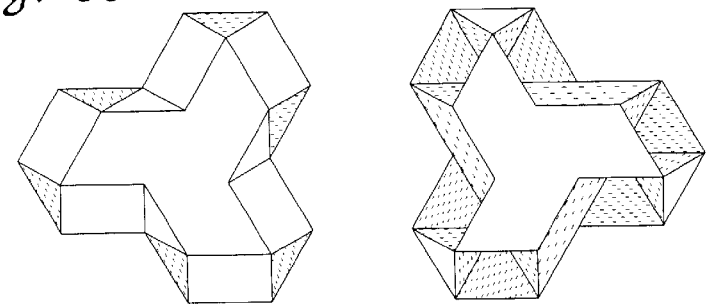
Fig. 67

SYSTEM AND SET OF INTERCLEAVING DICHOTOMIZED POLYHEDRAL ELEMENTS AND EXTENSIONS

CROSS-REFERENCE TO RELATED APPLICATIONS

This application claims the benefit of U.S. Provisional Patent Application Serial No. 60/077,908, filed Mar. 13, 1998, and Ser. No. 60/092,842, filed Jul. 14, 1998, the disclosures of which are incorporated herein by reference.

Copyright Notice

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsover.

FIELD OF THE INVENTION

The current invention relates to a system for toy or real construction elements, as well as molecular and crystal modeling tools, which may be implemented in either a physical or virtual reality. The goals of the current invention are: 1) to provide educational, entertaining, and constructional value while providing a means of visualizing and exploring the principles and realms of space filling, space sharing, three dimensional tiling, and three dimensional fractals; and 2) to provide a logic puzzle and an entertaining metaphor for many of life's challenges.

Background Art

Prior to the current invention, most construction elements of any similar nature could be placed into one or more of four categories:

1) Stacking Blocks—which provide no means for self-retention of assembled structures, other than gravity; but require some form of bonding material if they are to be secured in their relative positions;
2) Member Suspended Interconnected Elements—which require rods or other secondary connective devices to determine and/or secure their relative positions in space; and
3) Slotted circular or polygonal discs—while interfitting or intercleaving, their teachings do not lend themselves to producing nonplanar elements required to emulate real world, molecular building blocks. Assemblies produced with such planar elements are not substantially space filled.
4) Interfitting Surface Indentations—where complimentary patterns of protrusions and indentations provide for the alignment and mating of the surfaces of their generally polyhedral forms in a manner/direction which is orthogonal with respect to those mating surfaces.

No prior art has attempted to produce self-interfitting, self-retaining construction elements which produce substantially space-filled structures/assemblies. Most construction elements of prior design attempt to make their use more obvious and easy; while a significant portion of the current inventions value as an entertainment device and educational tool is the mystery, puzzlement, and challenges it presents due to the tendency of its various embodiments to retain the natural restraints associated with real-world elemental building blocks. Some examples of possible applications for the elements of the invention are as follows:

1) the restricted intercleaving nature of the elements may be used to demonstrate the intercleaving nature of covalent chemical bonds;
2) some of the required assembly and disassembly methods for the elements are analogous to thermal contraction and expansion in solids;
3) other assembly and disassembly methods emulate crystal growing and cleaving;
4) the natural inclination for the elements to produce mirror image (enatiomorphic) structures may be used to demonstrate both right-hand rotating (dextrorotary) formations and left-hand rotating (levorotary) formations, such as during growth of organic substances and crystals;
5) the self-similar nature of assembled supersets of the elements of the invention may be used to emulate the development of polymer compounds from smaller polymer and monomer building blocks;
6) the self-similar nature of the assembled elements may also be used in creating complex embodiments and assemblies enabling a new means of representing the fractal nature of the physical world; and
7) the ability of select embodiments of the invention to more naturally implement assemblies with fivefold symmetry may assist in demonstrating and explaining recently discovered chemical compounds with similar, but unexpected, symmetries.

Accordingly, the building blocks of the invention are capable of not only modeling the net result of molecular and crystal formations, but also of simulating the nature of the difficulties and processes involved in forming such chemical assemblages. Part of the challenge associated with the use of the current invention is that once one has determined which elements are needed and where they must go in order to create a given assembly, the user must still figure out how to get them there; once again simulating the very nature of creating assemblies of chemical elements.

In summary, although many prior teachings demonstrate the combining of polyhedral elements into larger assemblies, none of these construction elements mate non-orthogonally with respect to the engaging surfaces without some form of adhesive or secondary connection device or mechanism to implement the connection or to retain their interconnected alignments. Although most of the manufactures defined by the invention do not result in fully space-filled assemblies, all assemblies resulting from the use of the present invention are substantially more space-filling than any of the planar intercleaving manufactures of any prior art. Finally, no prior art provides the ability to produce the uniquely elegant assemblies enabled by the present invention.

SUMMARY OF THE INVENTION

The invention is a system and set of intercleaving (interfitting and adhering) elements which may be used as structural elements, building blocks, construction components, modeling elements, or the like. Each of these discrete structural elements is comprised of a plurality of pyramids, or other polyhedral members, clustered around at least one central point in such a manner that the resulting cluster or clusters form a discrete structural element. The polyhedral members may be joined at least partially along coincident edges for maintaining the structural stability of the element. A portion of the joining coincident edges of the polyhedral members are slotted or not completely joined ("difurcated") on the outer half of the joining edge to facilitate interfitting of a first element with a second element.

Accordingly, each element of the invention has the ability to be interfitted with other complimentary elements in a mutually interfitting and adhering manner (i.e., "intercleaving") along the coincident edges of sets of diagonally adjacent polyhedral members (such as pyramids) which have been difurcated along an outermost portion of their coincident edges which radiate from their coincident central point. The primary mechanism for the mutual cleaving or adherence of the interfitted elements is friction, enhanced by wedging forces, due, in part, to the relatively narrow nature of these provided clefts, slots, or slits (collectively or interchangeably referred to as "difurcations") formed in the coincident edges of the polyhedral members which make up each element. However, the effectiveness of their intercleaving properties may be enhanced by the addition of a variety of standard techniques for increasing their resistance to disassembly, including locking mechanisms or other protrusions or undulations.

Consequently, the present invention provides a unique structural element, building block, modeling element, construction component, puzzle, or the like. The elements of the invention may be intermitted into a variety of configurations and arrangements. Thus, the present invention effectively combines a plurality of polyhedral members into discrete elements, and enables those elements to interfit with and adhere to complementary elements also formed of a plurality of polyhedral members. Accordingly, it will be apparent that the present invention provides a novel, aesthetic, and unconventional structural element.

BRIEF DESCRIPTION OF THE DRAWINGS

FIG. 1 illustrates a first embodiment 10 of a pentahedral-comprised structural element of the invention interfitting with a complimentary second embodiment 20 of a tetrahedral-comprised structural element of the invention.

FIG. 2 illustrates a pentahedral equilateral square based pyramid.

FIG. 3 illustrates a tetrahedral equilateral triangular based pyramid.

FIG. 15*a* illustrates an orthographic view of a cuboctahedron space definition perpendicular to one of its eight triangular surfaces.

FIG. 15*b* illustrates an orthographic view of the reverse of the cuboctahedron space definition of FIG. 15*a*, with the cuboctahedron having been flipped left to right.

FIG. 27 illustrates an enlarged view of a slit-implemented edge set difurcation of first element 10 of FIG. 1.

FIG. 28 illustrates an enlarged view of intercleaving diagonally adjacent pyramids of complimentary elements of FIG. 1.

FIG. 29 illustrates an enlarged view of a slot-implemented edge set difurcation of second element 20 of FIG. 1.

FIG. 35 illustrates a pattern for producing a sheet material blank used to produce pentahedral-comprised structural element 10 of the first embodiment of the invention.

FIG. 36 illustrates a pattern for producing a sheet material blank used to produce a tetrahedral-comprised structural element 20 of the second embodiment of the invention.

FIG. 37*a* illustrates a perspective side view of a third embodiment of a combined structural element 70, which combines the first and second structural elements 10, 20.

FIG. 37*b* illustrates a bottom view of the structural element 70 of FIG. 37*a*.

FIG. 37*c* illustrates a top view of the structural element 70 of FIG. 37*a*.

FIG. 39 illustrates a pattern for producing a sheet material blank used to produce structural element 70 of a third embodiment of the invention.

FIG. 44 illustrates a view depicting the challenge of adding a sixth element to an assemblage of five.

FIGS. 45*a* & 45*b* illustrate views of two mutually enatiomorphic hexagonal assemblages, with 45*a* being the goal of the challenge of FIG. 44.

FIG. 46 illustrates one of three methods of accomplishing one of the goals of FIG. 44.

FIG. 47 illustrates two emulated ring compounds interfitted to form a larger structure.

FIG. 54*a* & FIG. 54*b* illustrate two views of an Intercleaving Building Block based on, or extended/projected to, an Octahedron Space Definition, illustrating both peripherally based and radially based pyramid clustering.

FIG. 55 illustrates a view of the most basic (first-order) embodiment of an octahedron space definition.

FIGS. 56*a* & 56*b* illustrate two views of the element depicted in FIGS. 52*a* & 52*b* after being projected to an octahedron space definition.

FIGS. 57*a* thru 57*d* illustrate views of four Intercleaving Building Blocks based on an Icosahedron Space Definition, demonstrating more generalized definitions of an edge set, diagonally adjacent and facially adjacent polyhedrons, and complex/composite polyhedrons.

FIGS. 58*a* thru 58*c* illustrate three views of an Intercleaving Building Block based on a quindecahedron (15-faceted) space definition.

FIG. 63*a* illustrates an embodiment based upon fusing the assembly illustrated in FIG. 40, comprised of a first embodiment element 10 interfitted with a second embodiment element 20, which are fused together to form a single contiguous element.

FIG. 63*b* illustrates a view of the element of FIG. 63*a* rotated 180 degrees.

FIG. 63*c* illustrate a bottom view of the element of FIG. 63*a*.

FIG. 64 illustrates an embodiment based on a fusing of three first embodiment elements 10 with a single centrally-located second embodiment element 20.

FIG. 65 illustrates an embodiment based on a fusing of three second embodiment elements 20 with a single centrally-located first embodiment element 10.

FIG. 66 illustrates the embodiment of FIG. 64 with the tetrahedral voids filled in.

FIG. 67 illustrates the embodiment of FIG. 65 with the central tetrahedral void filled in.

DETAILED DESCRIPTION

Definition of Terms

Figure 4:
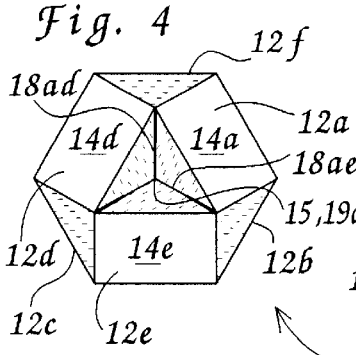
FIG. 4 illustrates a reduced-size view of the pentahedral-comprised structural element 10 of the first embodiment of the invention.

The following generalized terms are here defined.

Blending of Surfaces—any smoothing deviation from the angular intersection of the planar polyhedron surfaces, or the increasing of intersection angles via the truncation of said intersections to form one or more additional planar facets or otherwise smooth surfaces.

Cell, Cell Definition—any defined portion of a space definition which is potentially physical (filled, occupied) or spatial (empty, unoccupied).

Cleaving—refers simultaneously or individually to both literal senses of the word, namely 1) to pierce, to split; to separate and 2) to adhere to; to cling to, to grasp.

Cleft—1) "an opening made by or as made by cleaving; crack; crevice" 2) "a hollow between two parts" (applied more generally herein as: between two or more parts); although the term cleft would imply a visibly noticeable gap, it is used herein to refer to any difurcation including slots or slits which may leave the separated edges/polyhedrons in contact but unconnected.

Cuboctahedron—a fourteen sided polyhedron whose faces consist of six equal squares and eight equal equilateral triangles, and which can be formed by cutting the comers off a cube.

Deltohedron—also known as: deltoid dodecahedron, or tetragonal tristetrahedron; a dodecahedron having twelve quadrilateral/tetragonal surfaces, including the rhombic dodecahedron.

Diagonally Adjacent—structures or, more specifically, polyhedral elements which adjoin or coexist along generally coincident or overlappingly collinear edge lines, or along any expansion of that common edge line used to facilitate their connection., but which share no common sides/surfaces, i.e. have no coincident or overlappingly coplanar surfaces, are said to be diagonally adjacent.

Difurcations—any separation of two or more elements of a manufacture resulting in a plurality of branches or peaks, where said difurcations may include slots or slits which may leave the separated elements in contact but unconnected. The general use of this term is intended to include provisional difurcations. In virtual manufactures, where difurcations may be infinitely narrow, the term may simply refer to [mean] any portion of the coincident lines of a manufacture's one dimensional edge set which is allowed to share their one dimensional space with the virtual difurcation of the one dimensional edge set of a similar manufacture. Therefore, in virtual reality, any or all edge sets may be thought of as being 100% difurcated.

Dodecahedron—a twelve faceted polyhedron.

Edge Set—(Edgeset) any cluster of two or more coincident polyhedral edges resulting from diagonally adjacent polyhedrons. An edge set is said to have been formed (to exist) if at least two diagonally adjacent physical polyhedral elements and at least two spatial polyhedral elements share coincident edge lines.

Ellipsoidal—having the shape of a solid whose plane sections are all ellipses or circles, including spheroids and spheres.

Fillet—a fairing or other smoothing of the outline or shape of an element or structure.

Geodic Macro manufactures—geodic in form; "earthlike"; assemblages of embodiments of the current invention where said assemblages are generally spherical or otherwise ellipsoidal in shape and may encompass a central cavity, even though said ellipsoidal assemblages may also be viewed as being generally polygonal in shape.

Implied Surface—1) any surface which is not physically present but whose presence is defined by, or suggested by the logical extension of, bounding and surrounding points, lines, and/or surfaces; i.e., logically extrapolated from surrounding features. 2) any surface of a specified space definition which limits any further extension of the definition of an otherwise defined spatial polyhedron or cell and, therefore, serves as a defining surface of said spatial polyhedron or cell.

Intercleaving—mutually cleaving elements; two or more elements which simultaneously interfit and/or cling to each other, with each element doing so with two or more protrusions.

Physical Polyhedral Elements—may be solid, hollow, open faced, or framed (including wire-framed) in nature. Physical polyhedral elements may also be defined as any substantial occupancy of a polyhedral cell (i.e. subdivision) of a given space definition.

Plane of Inversion—any specified plane section of a three dimensional whole which delineates the portion of that whole which is to be spatially inverted and that portion which is to remain uninverted.

Polyhedron (polyhedrons, polyhhedra)—any element or space definition which is generally polyhedral in shape.

Prismatic—having a shape whose ends are parallel, polygonal, and equal in size and shape, and whose sides are parallelograms.

Project—"to transform the points of a geometric " "figure into the points of another figure"; to extend and/or truncate the defining points of a manufacture to conform with the form of another geometric form or space definition. Such projections may be made between concentric space definitions or between space definitions whose centers have been offset. Similarly, the source and target space definitions need not be synchronized, i.e. symmetrically aligned, but may be rotated with respect to each other in a manner resulting in a projected embodiment which does not retain the symmetry of either of its parent space definitions.

Provisional Difurcations—any difurcation provided for, but not implemented during the primary manufacturing phase; where actual implementation of said Difurcations, as a subsequent manufacturing phase to be performed by intermediate or end users, is required, directed, or implied; or where an impetus for implementing such difurcations is provided. Such an impetus may merely be a picture or diagram of a structure resulting from or suggesting the intermitting of so difurcated embodiments of the current invention. If the provisional difurcation is sufficiently thin, the actual difurcation may be produced when complimentary manufactures are first interfitted by the end user.

Quadecahedron—a fourteen faceted polyhedron, including the cuboctahedron.

Quindecahedron—a fifteen faceted polyhedron.

Rhombic Dodecahedron—a dodecahedron whose twelve facets are rhombuses.

Sculpted Surface—any surface which deviates from the theoretical planar or otherwise smooth or continuous surface of a generally defined shape. This term, as used in this document, is not intended to imply any given method of achieving these deviations.

Sculpting—Any blending or other deviation from the theoretical norm of a line, plane, or surface of a polyhedral or other geometric shape or form. Examples of which would include: undulations, serrations, gougings, dimplings, texturing, truncations, protrusions, projection (extension or truncation), filleting, or shrinking from its theoretical or nominal definition/location. This term, as used in this document, is not intended to imply any given method of achieving these deviations.

Space Definition—any set of points and resulting peripheral planes defined by these points, or any other specified surfaces or geometric form, which define the confines of a limited universe of space under consideration for: 1) occupancy by comprising polyhedral elements; or 2) division and/or further subdivision into spatial cells wherein said cells may be physically occupied, partially occupied, or unoccupied by the material(s) or virtual material used to form the manufacture or virtual manufacture under consideration and wherein said cells so occupied may be viewed as comprising physical and/or spacial elements of said manufacture. An example of a space definition would be the regular cuboctahedron whose twelve peripheral points (vertices) define the fourteen peripheral planar surfaces 30 & 32 (FIGS. 15*a* & 15*b*) which form the confines of each of the two components of the complimentary pair of preferred embodiments of the current invention described herein as the first and second embodiments 10, 20 (FIG. 1).

Spatial Dichotomization—dividing or redefining a physical or spatial whole into physical and spatial elements.

Spatial Inversion—a reversal of the physical or spatial specification/definition of one or more comprising elements; changing a portion or the entirety of one or more elements of a physical or spatial whole into its physical/spatial inverse.

Substantially Complementary—elements which are sufficiently complimentary of each other to allow some portion of themselves to interfit within and/or around each other, i.e., to intercleave.

Virtual Manufacture—computer generated manufactures on/in any two or three dimensional display or stereo viewer. Virtual reality is no longer merely an academic tool, but has become a very real medium for the manifestation of manipulatable competitive manufactures. Such manufactures, whether on a two-dimensional display, in the perceived space produced by a virtual reality helmet, or manifested in some futuristic three-dimensional display or medium, may be moved across the user's field of vision or interfitted with other such manufactures. The specific computer hardware, software, and algorithms used to dynamically manufacture a virtual manufacture are as secondary to the resulting virtual manufacture as are the machinery, materials, and manufacturing techniques and processes used are to an otherwise identical physical manufacture.

Virtual Matter—any defined set of points in a virtual reality which is not allowed to be or is otherwise restricted in some manner and/or degree from being shared with any similarly defined set of points. (In any given virtual reality it is possible to modify "the laws of physics", as we normally think of them, to allow conditional sharing of space by two or more sets of "matter".) Any such set of points may be moved, modified, or otherwise manipulated in accordance with a set of "laws of physics" as defined for the specific virtual reality in which said virtual matter has been defined.

Virtual Reality or virtual medium—any manipulatable existence comprised of virtual space and virtual matter.

Virtual Space—any portion of a virtual reality which is available for unrestricted occupancy by virtual matter.

Webbing—the material provided to connect diagonally adjacent polyhedrons to each other along a portion of their coincident edge set. In virtual manufactures, where webbing may be infinitely narrow, the term may simply mean the inner portion of the coincident lines of a manufacture's one dimensional edge set which are not allowed to share their one dimensional space with the virtual webbing of the one dimensional edge set of a similar manufacture.

Description of the Preferred Embodiments

The invention is directed to a set and system of interfitting structural elements which may be used for building structures, creating models, amusing and entertaining people, or the like. FIG. 1 illustrates a first embodiment 10 of a pentahedral-comprised structural element of the invention being interfitted with a second embodiment 20 of a tetrahedral-comprised structural element of the invention. The first and second preferred embodiments of the current invention are a complementary pair of first and second structural elements 10, 20, respectively, each being the spatial inverse of the other. Neither of these two embodiments 10, 20 are intended to be interfitted with identical elements, but instead, are paired with each other or with other substantially complimentary embodiments. However, the second embodiment 20 of the two elements is capable of being mated with identical elements 20 in a partially complimentary manner, producing some unique capabilities.

For purposes of clear explanation, FIGS. 2 and 3 are provided to illustrate basic shapes used in first pentahedral-comprised structural element 10 and second tetrahedral-comprised structural element 20. FIG. 2 illustrates an equilateral, pentahedral, squared based, pyramid 12 of the invention. Pyramid 12 has a square base 14 and four equilateral triangle radial sides 16 which are joined at their respective edges 18, and which meet at a summit or apex 19. FIG. 3 illustrates an equilateral, tetrahedral pyramid 22 having a triangular base 24 and three identical equilateral triangle radial sides 26 which are joined at their respective edges 28, and which meet at a summit or apex 29. It will be apparent that the base 24 and sides 26 of tetrahedral pyramid 22 are distinguishable from each other based only upon orientation (i.e., base 24 is identical in size and shape to each of sides 26), whereas the base 14 of pentahedral pyramid 12 is distinguishable from sides 16 based upon size and shape.

Figure 5:
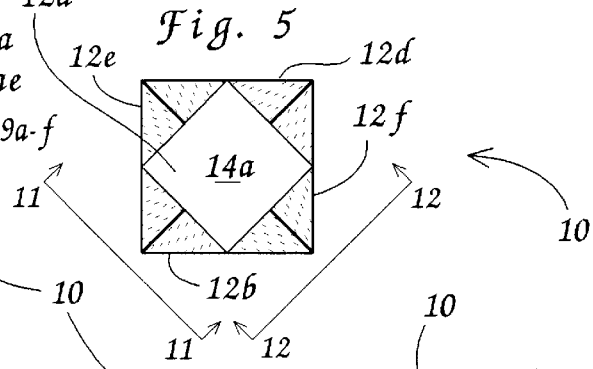
FIG. 5 illustrates a plan view of the structural element 10 of FIG. 4.
Figure 9:
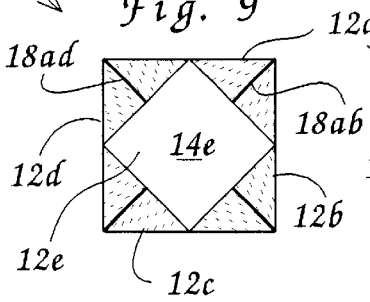
FIG. 9 illustrates a left side view of the structural element 10 of FIG. 5
Figure 6:
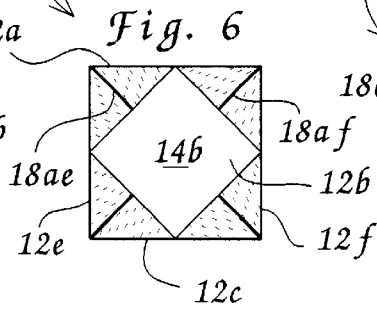
FIG. 6 illustrates a front view of the structural element 10 of FIG. 5.
Figure 10:
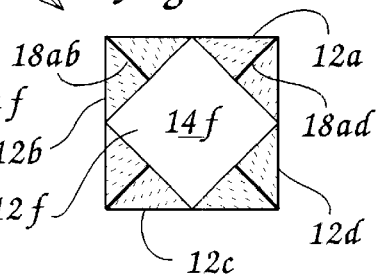
FIG. 10 illustrates a right side view of the structural element 10 of FIG. 5.
Figure 7:
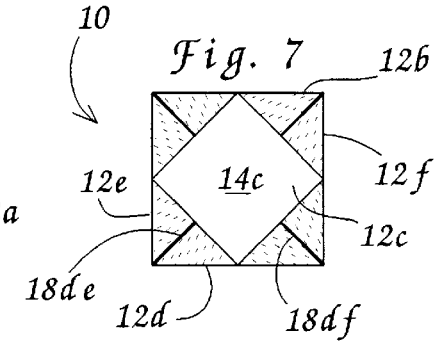
FIG. 7 illustrates a bottom view of the structural element 10 of FIG. 5.
Figure 11:
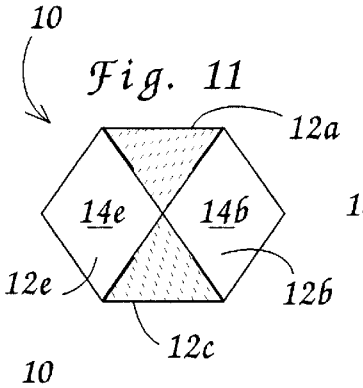
FIG. 11 illustrates a Left-Front orthographic view of the structural element 10 illustrated in FIG. 6, rotated 45 degrees to the right.
Figure 12:
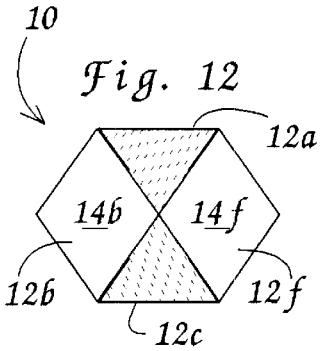
FIG. 12 illustrates a Right-Front orthographic view of the structural element 10 illustrated in FIG. 6, rotated 45 degrees to the left.
Figure 8:
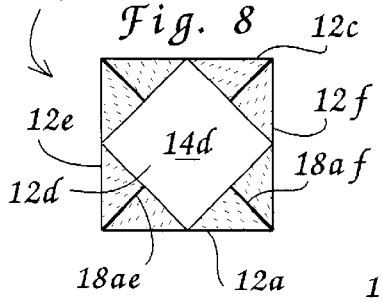
FIG. 8 illustrates a rear view of the structural element 10 of FIG. 5.
Figure 13:
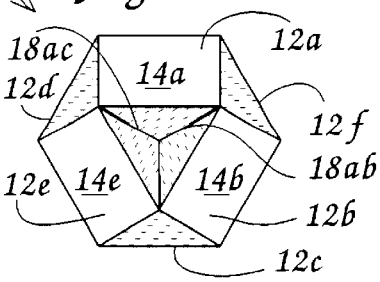
FIG. 13 is an orthographic view of the structural element 10 depicted in FIG. 11 rotated front-down approx. 35.25 degrees, doubling as an isometric view.
Figure 14:
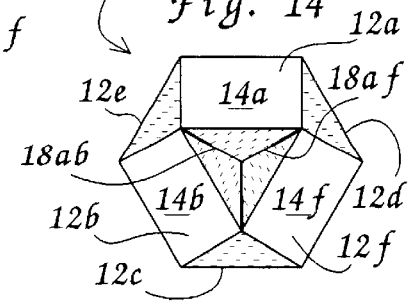
FIG. 14 is a n orthographic view of the structural element 10 depicted in FIG. 12 rotated front-down approx. 35.25 degrees, doubling as an isometric view.
Figure 16:
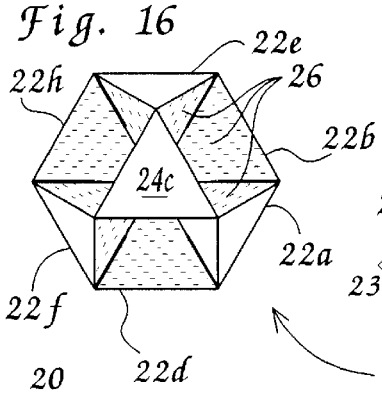
FIG. 16 illustrates a reduced-size view of the tetrahedral-comprised structural element of the second embodiment of the invention.
Figure 17:
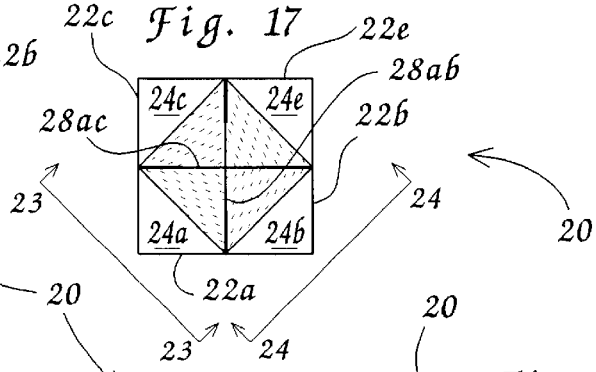
FIG. 17 illustrates a plan view of the structural element 20 of FIG. 16.
Figure 21:
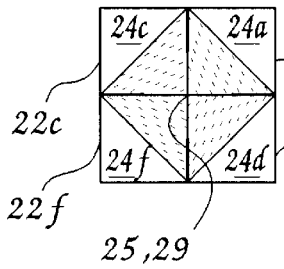
FIG. 21 illustrates a left side view of the structural element 20 of FIG. 17
Figure 18:
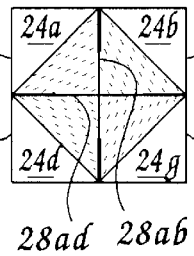
FIG. 18 illustrates a front view of the structural element 20 of FIG. 17.
Figure 22:
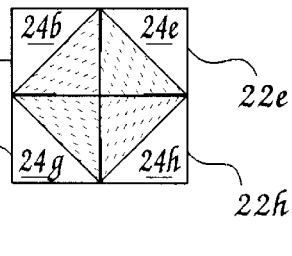
FIG. 22 illustrates a right side view of the structural element 20 of FIG. 17.
Figure 19:
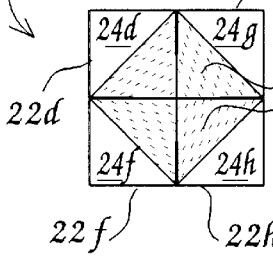
FIG. 19 illustrates a bottom view of the structural element 20 of FIG. 17.
Figure 23:
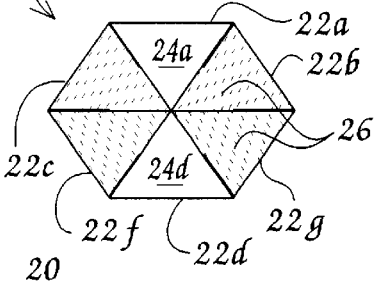
FIG. 23 illustrates a Left-Front orthographic view of the structural element 20 illustrated in FIG. 18, rotated 45 degrees to the right.
Figure 24:
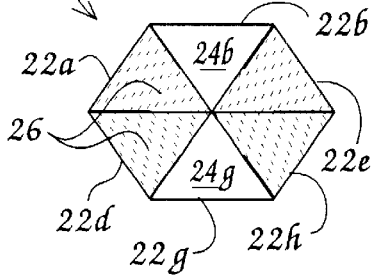
FIG. 24 illustrates a Right-Front orthographic view of the structural element 20 illustrated in FIG. 18, rotated 45 degrees to the left.
Figure 20:
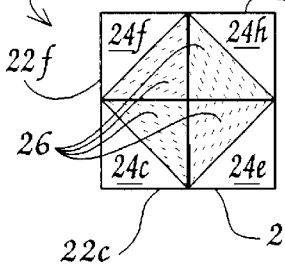
FIG. 20 illustrates a rear view of the structural element 20 of FIG. 17.
Figure 25:
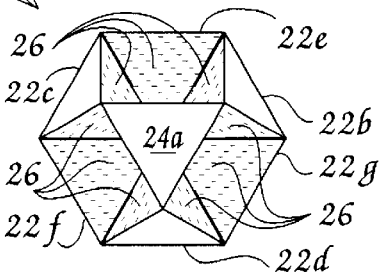
FIG. 25 is an orthographic view of the structural element 20 illustrated in FIG. 23 rotated front-down approx. 35.25 degrees, doubling as an isometric view.
Figure 26:
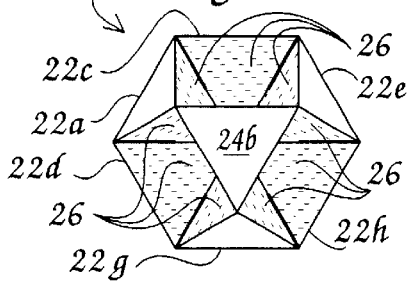
FIG. 26 is an orthographic view of the structural element 20 illustrated in FIG. 24 rotated front-down approx. 35.25 degrees, doubling as an isometric view.

FIGS. 4–14 further illustrate pentahedral-comprised structural element 10 of the first embodiment of the invention. Pentahedral-comprised element 10 is comprised of six equilateral pentahedral, square-based pyramids 12*a*–12*f* arranged in a clustered manner which results in their six apexes or summits 19 being coincident at a single central point 15, and each of the four radial edge lines 18 of each pyramid 12*a*–12*f* being coincident with one edge line 18 of each of four diagonally adjacent pyramids 12*a*–12*f*. For example, as illustrated in FIG. 5, four pyramids 12*d*, 12*f*, 12*b*, & 12*e*, are diagonally adjacent to pyramid 12a, with each pyramid 12*d*, 12*f*, 12*b*, & 12*e* sharing a single radial edge line 18*ad*, 18*af*, 18*ab*, & 18*ae*, respectively, with pyramid 12*a*, as illustrated in FIGS. 4 and 6–14. Furthermore, pyramid 12*a* is diametrically opposed to a fifth pyramid 12*c*, and pyramid 12*c* is also diagonally adjacent to the four pyramids 12*d*, 12*f*, 12*b*, & 12*e*. Thus, each of the six pyramids 12*a*–12*f* is centrally disposed relative to four diagonally adjacent pyramids 12*a*–12*f*, and diametrically opposed to a fifth pyramid 12*a*–12*f*.

With pyramids 12*a*–12*f* so arranged, their six peripherally oriented square bases 14 correspond to six square surfaces or facets 30 of a cuboctahedron space definition, as illustrated in FIGS. 15*a* & 15*b*. A cuboctahedron is a fourteen sided polyhedron whose faces or facets consist of six equal squares and eight equal equilateral triangles, and which can be formed by cutting the comers off a cube. It may be seen from FIG. 1 that structural elements 10, 20 are both based upon the cuboctahedron structure, but are spatial inverses of each other. Accordingly, portions of element 10 are able to fit into spaces in element 20 and vice versa. Further, it will be apparent that the bases 14 of each pentahedral pyramid 12 are located in accordance with the square facets 30 on the cuboctoahedral space definition, and bases 14 may be described as facets of first element 10.

Thus, the arrangement of first element 10 includes eight spaces (i.e., voids or open areas) in the shape of eight spatial tetrahedral pyramids 22 being interspersed between and defined by the twenty-four radial sides 16 of the six pentahedral pyramids 12*a*–12*f*. There are eight implied triangular peripheral surfaces (openings) corresponding to the eight triangular surfaces 32 of the cuboctahedron space definition. (For the sake of clarity, numerical designations or lead lines to define the spatial areas of the current invention are generally not provided in the included drawings. Attempts to point to an open three dimensional space in/on a two-dimensional presentation can prove to be more confusing than clarifying.) Accordingly, first element 10 includes six solid pentahedral pyramids 12*a*–1 2*f*, which are arranged about central point 15, with their edges 18 aligned with adjacent edges 18 of pyramids 12*a*–12*f*, so that there are eight voids between pyramids 12*a*–12*f* in the shape of eight tetrahedral pyramids 22.

Turning now to the second structural element 20 of the invention, tetrahedral-comprised structural element 20 of the second embodiment of the invention is illustrated in FIGS. 16–26. Tetrahedral-comprised element 20 is comprised of eight equilateral tetrahedral pyramids 22*a*–22*h* arranged in an edge-aligned manner around a single coincident center point 25, with apexes 29 located at center point 25. For example, the edges 28 of tetrahedral pyramid 22*a* are aligned with the edges 28 of tetrahedral pyramids 22*b*, 22*c*, and 22*d*, and are shown as reference numbers 28*ab*, 28*ac*, and 28*ad*, respectively. Thus, each tetrahedral pyramid 22*a*–22*h* has its edges 28 adjacent to and aligned with the edges 28 of three other tetrahedral pyramids 22*a*–22*h*.

It will be apparent that tetrahedral pyramids 22*a*–22*h* of element 20 are also arranged within the same cuboctahedron space definition (FIGS. 15*a* & 15*b*) as for pentahedral-comprised structural element 10 of the first embodiment. Thus, the arrangement of second element 20 results in the volume of six spatial pentahedral pyramids 12 being interspersed between and defined by the twenty-four radial surfaces 26 of the eight physical tetrahedral pyramids 22*a*–22*h* and the six implied square surfaces (i.e., openings) corresponding to the six square surfaces 30 of the space definition, while the eight peripherally-based triangular surfaces 24*a*–24*h* of the tetrahedral pyramids correspond to the eight triangular surfaces 32 of the space definition. Accordingly any of the tetrahedral pyramids 22*a*–22*h* is coincident along its three edges 28 with the edges 28 of three other tetrahedral pyramids 22*a*–22*h*, with the apexes 29 of the tetrahedral pyramids 22*a*–22*h* located at center point 25, and with six pentahedral voids dispersed between the aligned tetrahedral pyramids 22*a*–22*h*. Furthermore, as described above with respect to the first embodiment 10, bases 24 of tetrahedral pyramids 22 correspond to the triangular facets 32 of the cuboctohedral space definition, and may be described as facets of second element 20.

Turning back to FIG. 1, in pentahedral-comprised element 10, each pair of diagonally adjacent pyramids 12 has coincident radial edge lines 18 which form an edge set 40 where the edges 18 of pyramids 12 meet. Similarly, in tetrahedral-comprised element 20, each pair of diagonally adjacent pyramids 22 forms an edge set 40 along their coincident radial edge lines 28. Thus, an edge set 40 may be defined as any cluster of two or more coincident polyhedral edges resulting from diagonally adjacent polyhedrons. An edge set 40 is said to have been formed (to exist) if at least two diagonally adjacent physical polyhedral elements and at least two spatial polyhedral elements share coincident edge lines.

In the embodiments 10, 20 of FIG. 1, and as also illustrated in FIGS. 27–29, the diagonally adjacent pyramids 12, 22, respectively, are interconnected along an inner portion of edge sets 40 by what will hereinafter be referred to as webbing 44 and are separated along an outer portion of these edge sets 40 by clefts 46 (also referred to as "difurcations"). Webbing 44 is the connecting material or fillets which is a necessary part of manufacturing a physical element 10, 20, and which are also necessary for maintaining structural integrity of elements 10, 20, by holding the polyhedral members in position. Clefts 46 extend inward from the outermost point of the edge sets 40, resulting in what will be referred to as difurcated edge sets 48. These clefts 46, alternately referred to as difarcations 46, may also be viewed as spatially connecting the diagonally adjacent spatial pyramids.

In each of the two preferred embodiments 10, 20, all twelve of the resulting edge sets 40 are equally difurcated to a depth equal to at least fifty percent of the edge sets 40 length. However, as long as structural integrity is maintained, each difurcation 46 may extend along any outer portion of the edge set's 40 length, including its entirety, with a complementary portion of the length of the appropriate edge set 40 of an intended mating element 10, 20 being suitably difurcated. In an extreme example, an edge set 40 of a first element 10 may be 100 percent difurcated, and a complimentary edge set 40 on a second element 20 may be undifurcated, and still be able to mate with first element 10.

In FIGS. 27–29, it can be seen that it is these clefts 46 which allow a pair of pentahedral lie pyramids 12 of first element 10, or a portion of them, to protrude into a pair of spatial pentahedral pyramids in second element 20 while the pair of physical tetrahedral pyramids 22 associated with the mating edge set 40 of second element 20 protrude into the pair of spatial tetrahedral pyramids associated with the relevant edge set 40 of the first element 10, in a mutually cleaving manner. During insertion, the webbing material 44 connecting the inner portion of the edge sets 40 of each element 10, 20 simultaneously slides into the clefts 46 of the other element 10, 20, as the elements 10, 20 become fully seated within each other. In the preferred embodiments, the webbing material 44 connecting the inner portion of the edge sets 40 is tapered and slightly wider than the clefts 46, providing greater wedging forces, to increase the frictional resistance to disassembly once fully assembled. This may be balanced against similar tapering of the clefts 46, as illustrated in FIG. 27, providing for easier mating and greater angular tolerance when interfitting multiple construction elements.

These clefts 46, which can be seen in greater detail in FIGS. 27–29, may be no more than slits as in FIG. 27, or slots as in FIGS. 28 and 29, or even broader. Clefts 46 are represented in unenlarged drawings, such as FIGS. 4–14 and 16–26, by broader lines, or not indicated at all, since not all edge sets which may be suitable for difurcation need be difurcated in a given manufacture. Furthermore, it will be apparent that each edge set 40 is non-perpendicular (oblique) to the facets (bases 14, 24) which make up the polyhedrons forming that edge set 40. For example, in first element 10, two pentahedral pyramids 12 have aligned coincident edges 18 which form an edge set 40. However, bases 14 of these two pentahedral pyramids form planar surfaces or facets which are non-perpendicular to the edge set 40, and which are also non-parallel to the edge set 40. This feature contributes to the non-intuitive manner in which the elements 10, 20 of the invention interfit with each other. It can be further seen from the drawings that this non-orthogonal relationship is due to the manner in which these edge sets peripherally terminate at the vertices or other points along the edges of these generally polyhedral embodiments and/or of the polyhedral space definition on/in which they are based and to which they generally conform. Such references to terminations at or along vertices or edges are irrespective of any truncation or filleting of those vertices or edges.

It should be further noted that the preferred embodiments described thus far have spherical symmetry. Accordingly, edge sets 40 radiate symmetrically in a radial manner from central point 15, 25, so that elements 10, 20 may be described as being spherically symmetrical. This facilitates connecting elements 10, 20 to other elements 10, 20 from a plurality of sides and angles, thereby increasing the variety of structures which may be formed by elements 10, 20.

Figure 30:
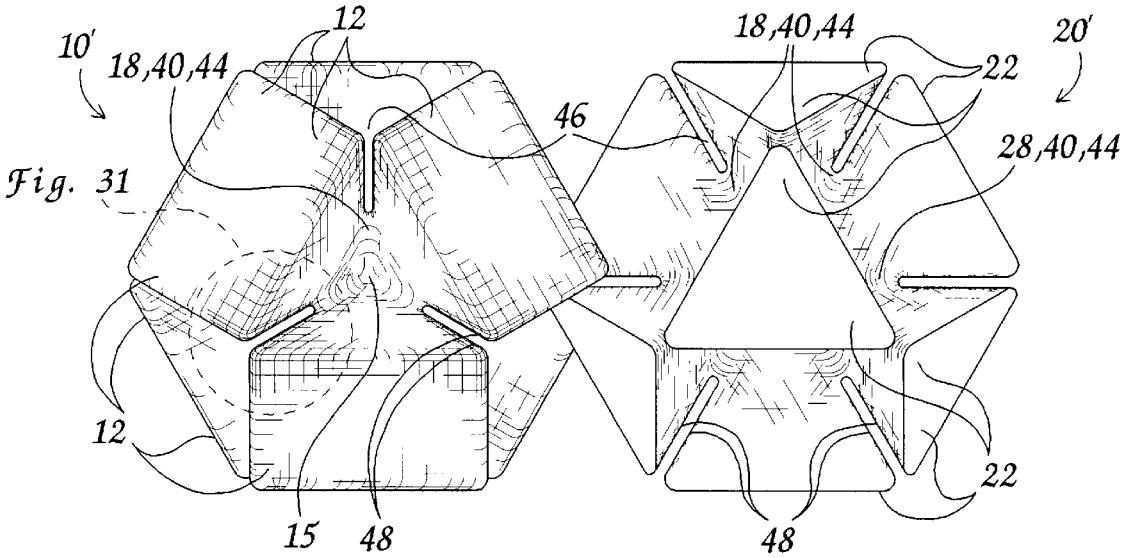
FIG. 30 illustrates an intercleaving complimentary pair of structural elements 10, 20, similar to FIG. 1, with a fully filleted pentahedral-comprised structural element 10 and partially filleted tetrahedral-comprised structural element 20.
Figure 31:
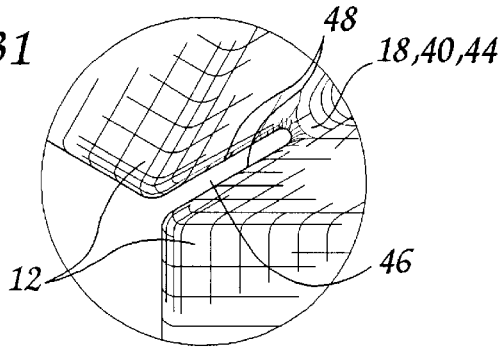
FIG. 31 illustrates an enlarged view of a fully filleted edge set and the resulting cleft and webbing.
Figure 32:
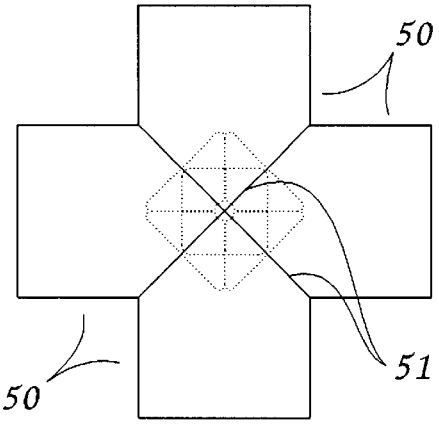
FIG. 32 illustrates a schematic diagram depicting/suggesting an approach to a four-piece molding system for producing structural element 10, shown in closed/engaged position.
Figure 33:
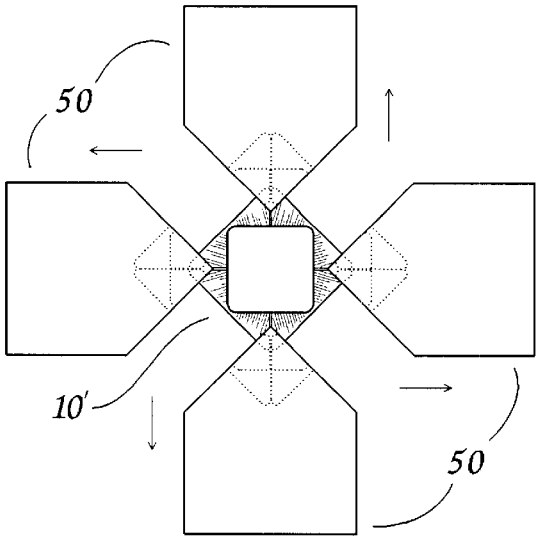
FIG. 33 illustrates a schematic diagram of the four-piece molding system of FIG. 32 shown releasing a molded structural element 10.
Figure 34A:
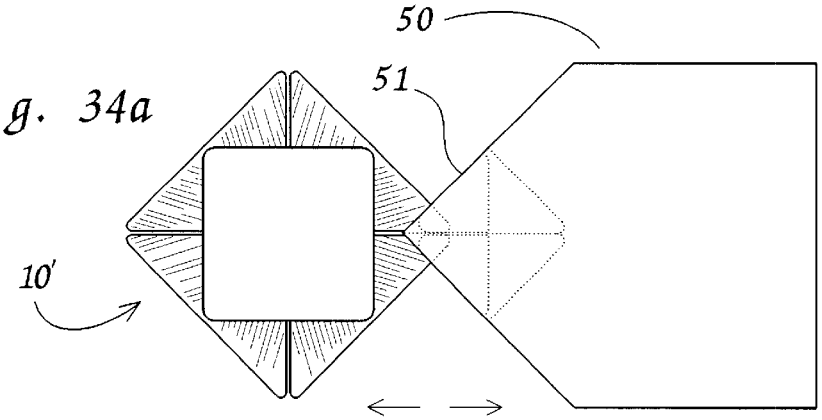
FIG. 34*a* illustrates an enlarged top view of one of the four identical molding dies depicted in FIGS. 32 & 33, shown disengaging the newly formed structural element 10.
Figure 34B:
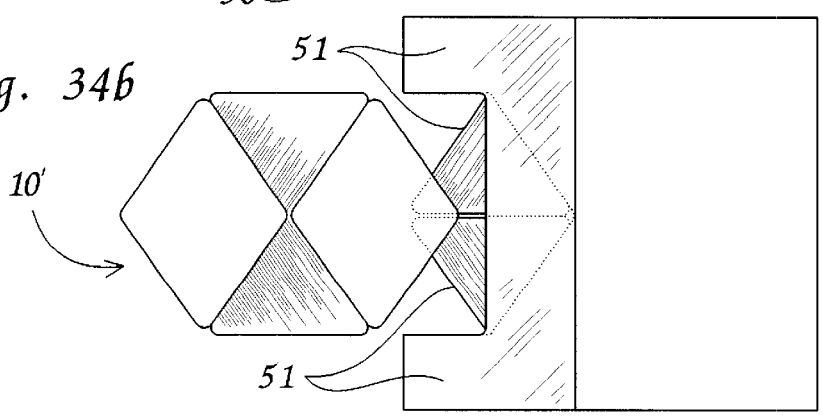
FIG. 34*b* illustrates a side view of the die and manufacture depicted in FIG. 34*a*.

FIGS. 30–31 illustrate slightly modified elements 10', 20' of FIG. 1, in which substantial filleting is added to the webbing 44 and clefts 46. Pentahedral-comprised element 10' includes a fully filleted webbing 44 and large clefts 46. In addition, all other edges of modified element 10 are rounded off, without changing the essential shape of element 10'. Similarly, modified tetrahedral-comprised element 20' includes fully filleted webbing 44 and large clefts 46, but is not rounded off on the outer edges in the manner of modified first element 10'. The modified elements 10', 20' would be more practical for manufacture by molding or the like, without substantially changing the function or appearance of the elements.

The best method of manufacture of the preferred embodiments is considered to be injection molding of a solid one piece element, where all of the described features are implemented simultaneously. Such an implementation would require molds consisting of at least four parts as suggested by FIGS. 32–34*b*. These diagrams illustrate a set of four identical dies 50 being used to form modified first element 10' with fully filleted features, as depicted in FIG. 30; though not all details of such a mold are presented here. For example, the details required to implement the other eight difurcated edge sets which lie along the mating planes 51 of the four dies are not shown, but the manufacturing of the elements 10, 20 is believed to be within conventional skills of those skilled in the art, and, accordingly, no additional description is believed to be required.

A similar system may be employed for the manufacture of the second described embodiment element 20. However, at least two differing pairs of identical dies may be required. Also, the use of more than the minimum number of component dies may be desirable particularly where regular retooling for a variety of embodiments is expected, or to simply minimize the visibility of resulting seams. The molding of any embodiments of the current invention may directly form the required clefts 46, or the clefts 46 may be provided as a subsequent step. This additional step(s) might involve any of a variety of machining processes or a literal cleaving of the edge sets 40.

A forced mechanical cleaving of the edge sets 40 would, assuming that other design characteristics, including webbing thickness and resiliency of used materials, allow the use of slits as clefts 46, provide particularly stealthy difurcations. Also, the resiliency of an appropriate manufacturing material would tend to re-close the formed clefts 46, making them less visible and more puzzling. The central portion of hollow versions of these manufactures may be similarly molded without the peripheral surfaces (e.g., pyramid bases 14 could be left out during the molding process, with pyramids 12 being hollow). These surfaces could be subsequently added using standard techniques. If these peripheral surfaces 14, 24 were not added, the resulting manufacture would be considered to be comprised of open faced pyramidal members.

Two computer controlled manufacturing techniques which may be particularly valuable for creating prototypes, if not production models, of the numerous possible variations on the preferred embodiments are: Successive Layer Deposition; and Convergent Beam Polymer Solidification. Similarly, elements 10, 20 may be machined from solid stock using automated numerically controlled equipment. An alternate method of manufacture would be to use adhesives or other bonding materials or techniques to assemble discrete polyhedral members into the forms described/claimed as the current invention.

In yet another manufacturing method, prototypes of various embodiments of the current invention have been created from sheet materials using patterned blanks similar to the ones depicted in FIGS. 35–36. These blanks have been used to produce prototypes of pentahedral-comprised element 10 and tetrahedral-comprised element 20, respectively. Each of these blanks is cut along the solid lines 58, including the slits 59, but excluding the lines associated with the center reference marking 60; and then folded toward its printed side along the dashed lines 61 and folded toward its unprinted side along the dotted lines 62. The resulting tabs 63 are then glued to appropriate surfaces to create the target manufactures as illustrated in FIGS. 1, 4–14 and 16–26.

Up to two optional reinforcements 64 may be added to pentahedral-comprised element 10 after the folding and gluing of the blank of FIG. 35 has been otherwise completed. Each reinforcement 64 being glued to three coplanar radial surfaces, one radial surface of each of three of the resulting pentahedral pyramids 12, providing otherwise unprovided webbing 44 for two more (a total of four more) of the resulting twelve edge sets 40. The remaining two unconnected edge sets 40 may be optionally glued along an inner portion of their length.

Up to twelve reinforcements 65 may be added to tetrahedral-comprised element 20 while the blank of FIG. 36 is being implemented. After being folded along its dashed line, each of these reinforcements 65 is glued to surfaces internal to the eight resulting tetrahedrons 22 along otherwise unconnected internal edge lines to provide additional support for otherwise unconnected intersecting surfaces which were further weakened by the provided slits. Once otherwise completed, the provided slits in any so constructed embodiments may be widened into slots to allow for the thickness of heavier sheet materials, or otherwise provided for with modifications to the basic blanks shown. In fact, if sheet metal, for example, were used to create larger embodiments, standard bend allowances, as appropriate for the materials in use, would have to be added to these patterns. Similarly, once otherwise completed, the outer vertices may be rounded and/or the slots/clefts 46 tapered, as illustrated in FIG. 27, along the edge sets 40 to allow easier mating and assembly.

Figure 38C:
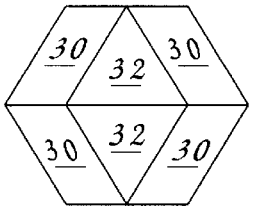
FIGS. 38*a*–38*c*, illustrate three views of a Non-Cuboctahedral Quadecahedron (14-faceted) Space Definition which provides the basis for the third embodiment 70.
Figure 38A:
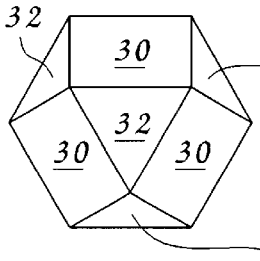
Figure 38B:
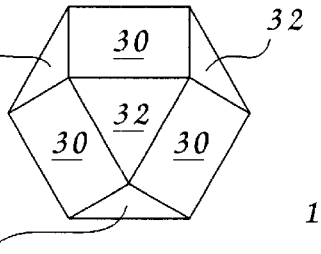

FIGS. 37*a*–37*c* illustrated a third embodiment of a combined element 70 of the invention. Combined element 70 has one half that is comprised of three physical pentahedral pyramids 12 and four spatial tetrahedral pyramids, and a second contiguous half that is comprised of four physical tetrahedral pyramids 22 and three spatial pentahedral pyramids. Thus, combined element 70 may be connected to either first element 10 or second element 20, and conforms to the noncuboctahedral equilateral quadecahedron (14-faceted) space definition illustrated in FIGS. 38*a*–38*c*.

FIG. 39 depicts a blank pattern used to create third embodiment combined element 70. Having portions of both of the blanks of FIGS. 35 and 36, the alphabetic gluing indices provided on the blank of FIG. 39 are also instructional for the use of the blanks of FIGS. 35 and 36. The lower case character indices indicate that the gluing surface is actually a corresponding location on the reverse (unprinted side) of the blank. Upper case indices indicate that the gluing surface is the location where the index character is actually printed (its obverse). In each case, an indexed tab 63 is mated with a location having the same but opposite case index character. For example, the reverse of tab "a" is glued to the obverse of location "A"; and the obverse of tab "S" is glued to the reverse of location "s". In each case, the tab is placed and glued along the side of the line that the location index indicates. The placement locations of the optional reinforcements 64, 65 have not been indicated, but are left to the discretion of the user, one of the first reinforcement 64 and up to six of the second reinforcement 65 may be used. Although some variation is acceptable, implementing the indexed gluing steps alphabetically is recommended. However, two tabs 63 (or even three, if reinforcements 64, 65 are included) must at times be glued simultaneously.

The use and usefulness of the current invention as both a construction element and as a puzzlement is demonstrated in FIGS. 40 thru 47. It can be also seen in these drawings that each assemblage of the preferred embodiments creates, in itself, a new larger intercleavable building block which, as an assembly, or fused or blended into a single monoelement as illustrated in FIGS. 63*a*–67, may be viewed and used as an embodiment of the current invention, as a construction element of yet larger more complex structures. In this respect, it can be said that the manufactures of the current invention form, or can, or may form, self-similar or fractalized structures or manufactures. Again, such assemblages or fusions may be viewed as Macro manufactures, and therefore, as macro-embodiments of the current invention.

Figure 48:
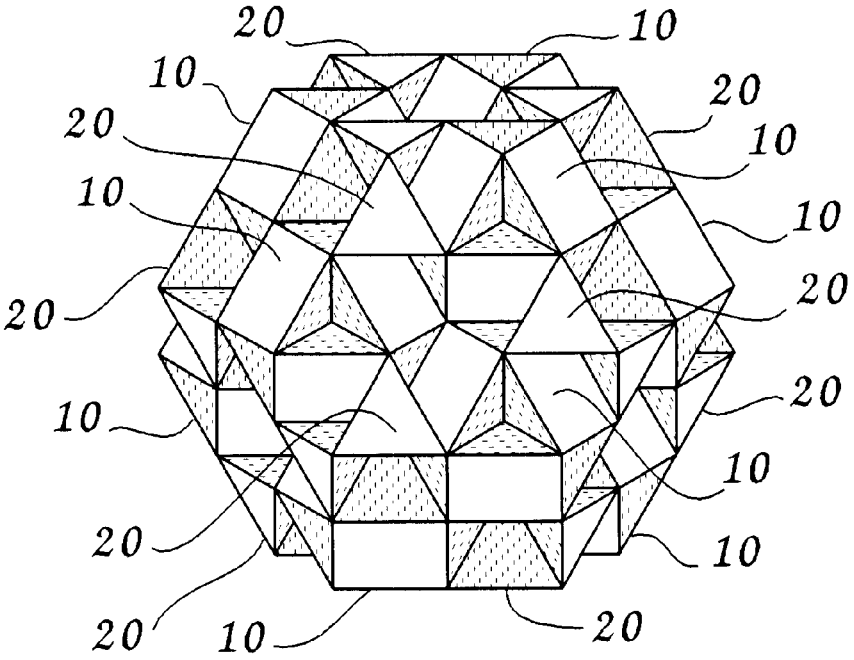
FIG. 48 illustrates a geodic assemblage of twenty-four elements, twelve elements 10 and twelve elements 20.
Figure 49:
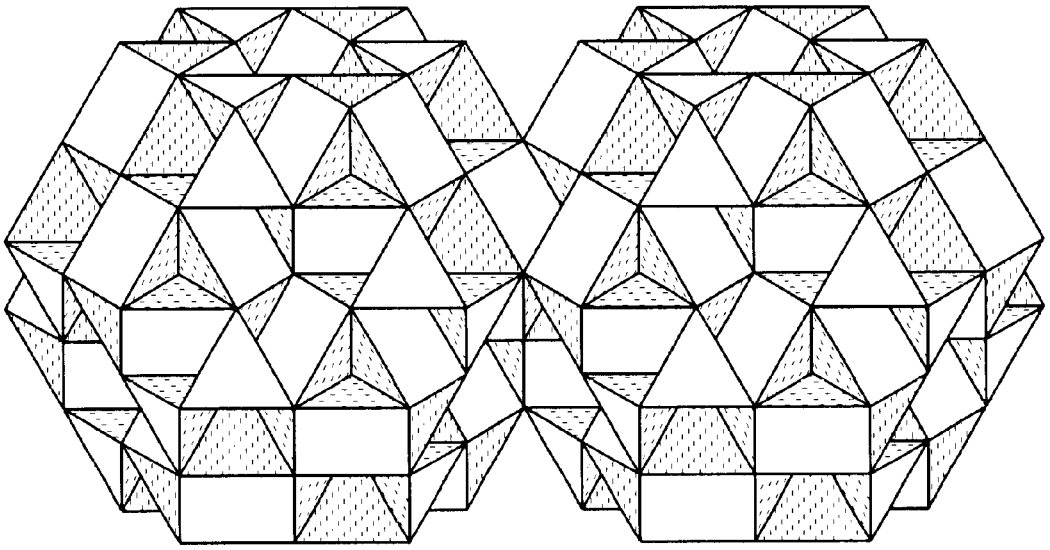
FIG. 49 illustrates two of the geodic assemblages of FIG. 48 interfitted as they function as fractalized intercleaving building blocks.

Even the geodic assembly of FIG. 48, comprised of twelve each of first element 10 and second element 20, is usable as an intercleaving building block to create even larger structures as illustrated in FIG. 49.

FIGS. 50*a* thru 53*b* illustrate how the basic use of a space definition can be further subdivided to define additional embodiments of this class of construction elements which is the current invention. In these cases, it is the cuboctahedron as employed by first element 10 and second element 20 which has been further subdivided.

Figure 50A:
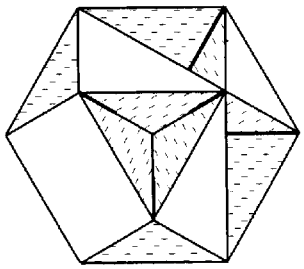
FIG. 50*a* thru FIG. 53*b* illustrate pairs of views of four examples of the further subdividing of the cuboctahedron space definition into additional embodiments of the current invention.
Figure 50B:
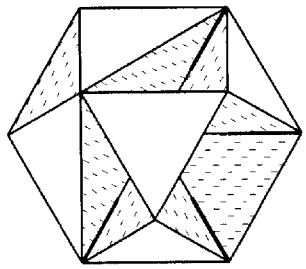
Figure 51A:
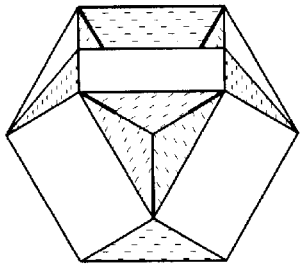
Figure 51B:
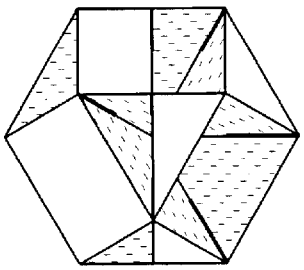

FIGS. 54*a* & 54*b* illustrate embodiments based on the projection of portions of the defining points of the cuboctahedral embodiment of FIGS. 50*a* & 50*b* into an octahedron space definition. Though not illustrated here, such basic embodiments may, in addition to being projected into other polyhedral space definitions, be projected into spherical or other ellipsoidal embodiments or into any other nonpolyhedral space definition.

FIG. 55 illustrates the most basic octahedral based embodiment of the current invention, where each facet of a polyhedral space definition is viewed as the base of a pyramid whose summit lies at the center of the space definition. These comprising pyramidal members are then alternately defined as either physical or spatial. The original physical whole may now be viewed as having been dichotomized into physical and spatial elements. The resulting edge sets are then difurcated as earlier described for first element 10 and second element 20. This may be viewed as a first-order embodiment of the current invention based on a first-order dichotomization of a defined space, i.e. of a space definition.

Figure 52A:
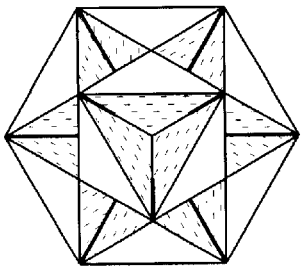
Figure 52B:
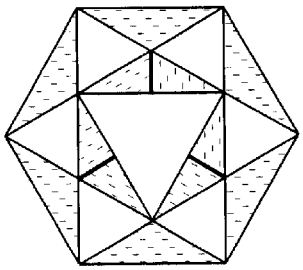
Figure 53A:
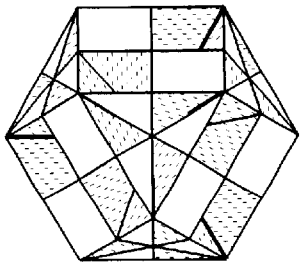
Figure 53B:
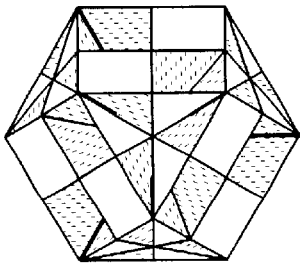
Figure 59B:
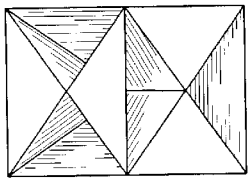
FIGS. 59*a* thru 59*c* illustrate three views of an Intercleaving Building Block based on a cubic (hexahedron) space definition.
Figure 59A:
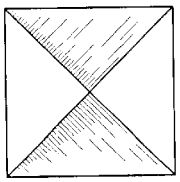
Figure 59C:
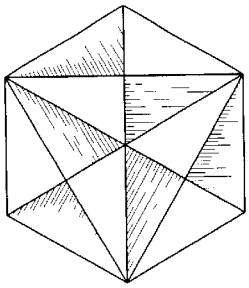

FIGS. 56*a* & 56*b* illustrate embodiments derived by further subdividing an octahedron space definition into polyhedral elements which extend to the center of the space definition. This may be viewed as a fifth-order embodiment of the current invention in that it may be viewed as having been formed by starting with the first-order embodiment of FIG. 55 and then, four times, dividing it into two sections and spatially inverting one of those two sections; with spatial inversion being the conversion of spatial elements into physical elements while simultaneously converting physical elements into spatial elements. Each successive cycle/phase of division and spatial inversion can be viewed as an additional level or order of dichotomization, spatial inversion, or spatial dichotomization. With this in mind we may now classify the first, second, and third embodiments (10, 20, and 70, respectively) as first-order embodiments, while the two embodiments depicted in FIGS. 50*a* & *b* and 51*a* & *b* are second-order embodiments. FIGS. 52*a* & *b* present two views of a fourth-order cuboctahedron based embodiment; and FIGS. 53*a* & *b* are two views of a seventh-order cuboctahedral embodiment of the current invention. These embodiments may also be viewed as resulting from second, fourth, and seventh-order spatial dichotomizations of a cuboctahedron who's resulting edgesets are subsequently difurcated. As an extension of the second-order embodiment of FIGS. 50*a* & *b*, that of FIGS. 54*a* & *b* may also be classified as a second-order embodiment.

Just as the five first-order embodiments depicted in FIGS. 57*a* thru 57*e* have not been uniformally dichotomized, subsequent dichotomizations need not be evenly distributed nor applied to the entirety of the manufacture, but may be applied to any number of or a single element of the previously defined embodiment. Similarly, subsequent dichotomizations need not be based on binary or centered divisions of the space definition, but may be the result of off-centered divisions, or multiple divisions to which spatial inversion is alternately applied.

These icosahedron based embodiments depicted in FIGS. 57*a* thru 57*e* also serve to illustrate the more general definitions of several terms used throughout this document. We first define a peripheral surface or facet of a comprising polyhedral element as any of its surfaces which coincide with or are generally aligned with a portion of the peripheral surfaces of the manufacture as a whole and/or the periphery of any confining space definition, and which do not radiate outward from the center of the manufacture. The periphery of the manufacture would include truncations of the vertices or edges of an extended space definition. For example, any embodiment based on the cuboctahedron may be alternately viewed as being cube or octahedron based, since the cuboctahedron is, by definition, the result of the truncation of either the cube or the octahedron by the other.

In the case of FIG. 57*a*, the surfaces indexed as A thru G identify seven of the peripheral facets of the depicted icosahedron based manufacture/embodiment as well as the seven underlying physical tetrahedral elements of the manufacture. (For simplicity, we are here ignoring those tetrahedral elements whose peripheral surfaces are not visible in these views.) Each of these same seven surfaces is also individually referred to as the peripheral facet or surface of each of the corresponding tetrahedral/pyramidal elements of the embodiment. In the embodiments of FIGS. 57*b* thru 57*e* the depicted sets of physical tetrahedrons are subsets of the set of tetrahedrons depicted in FIG. 57*a*, where one or more of them have been converted to spatial elements; i.e. removed or spatially inverted.

These seven tetrahedral elements of FIG. 57*a* may also be viewed as forming at least two complex composite polyhedrons comprised of facially adjacent tetrahedral pyramids. That is to say that facially adjacent tetrahedral elements A and B may also be viewed as composite polyhedron AB. Tetrahedrons A and B are said to be facially adjacent because they each have a facet which shares a common and, in this case coincident, planar space with the other. Similarly, the continuous string of facially adjacent tetrahedrons C through G may be viewed as the complex polyhedron CDEFG; or as any of several sets of smaller composite polyhedra such as (CD,EF, & G); (CDE & FG); & (DEFG); (CD, E, FG); etc. In this sense, a fully physical icosahedron can be viewed as a cluster of twenty facially adjacent tetrahedrons where each tetrahedron is facially adjacent to three surrounding tetrahedrons; and any subset of facially adjacent tetrahedral pyramids may be viewed as a polyhedral element of the icosahedral whole.

If any individual element or set of these tetrahedral elements of the whole are removed and thereby converted to space bounded by the remaining physical polyhedral elements, they may be similarly viewed as being spatial elements of this new whole. In FIGS. 57*a* and 57*b*, the spatial elements bounded by physical elements A, C, & F and A,C,E, & G respectively can be referred to as spatial elements acf and aceg respectively.

The term diagonally adjacent polyhedrons, or more specifically, diagonally adjacent pyramids is also illustrated here most simply in FIG. 57*e* where tetrahedral pyramids A,C, and F are each diagonally adjacent to the other two across their common edge lines collectively referred to as an edge set, in this case edge set ACF. Again, each tetrahedron can be viewed separately or as a portion of a more complex polyhedron. Therefore, in FIG. 57*a*, individual tetrahedron C can be viewed as being diagonally adjacent to tetrahedrons A and B individually or diagonally adjacent to the compound polyhedron AB across edge set ABC. Similarly, polyhedron AB may be viewed as being diagonally adjacent to compound polyhedron CDEFG at two points, across edge sets ABC and AFG. Similar to FIG. 57*e*, in FIG. 57*c*, compound polyhedrons AB, CD, and FG are each diagonally adjacent to the other two. In FIG. 57*b*, polyhedron CDE is diagonally adjacent to both G and AB, while G is also diagonally adjacent to AB.

The resulting edge sets visible in the dichotomized polyhedra of FIGS. 57*a, b*, & *c* have not been difurcated and would, therefore, not qualify as being intercleaving, as defined herein, unless one or more of their edge sets were in fact difurcated.

In FIG. 57*d* it can be seen that regardless of how one chooses to view elements F and G, element A has been separated, i.e. difurcated, from both F and G individually and as the composite element FG, producing what is herein referred to as a difurcated edge set. A more generalized example of a difurcated edge set can be seen in FIGS. 52*a* and 56*a* where edge sets formed by at least three diagonally adjacent elements have been difurcated, separating each of the elements from each of the others.

Figure 60B:
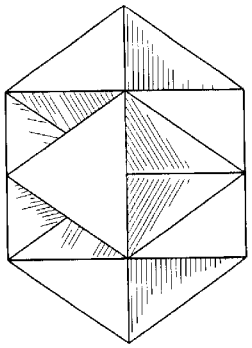
FIGS. 60*a* thru 60*c* illustrate three views of an Intercleaving Building Block based on a rhombic dodecahedron space definition, which may be also viewed as an extension from the embodiment of FIGS. 59*a* thru 59*c* into a rhombic dodecahedron space definition.
Figure 60A:
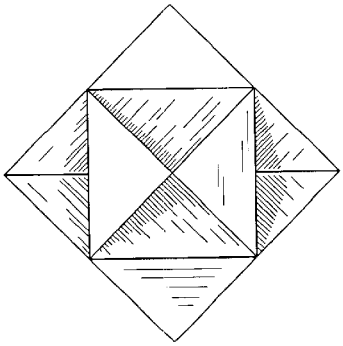
Figure 60C:
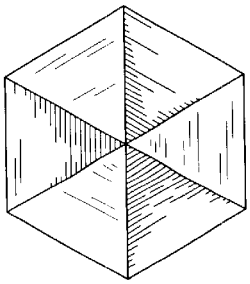

FIGS. 58*a* thru 58*c* provide three different views of a first-order quindecahedron based embodiment of the current invention. FIGS. 59*a* thru 60*c* provide three views of each of two seventh-order embodiments based on: 1) a cube space definition (FIGS. 59*a–c*); and 2) a rhombic dodecahedron space definition (FIGS. 60*a–c*). The latter may also be viewed as a projection of the cubic embodiment of FIGS. 59*a* thru 59*c* into the rhombic dodecahedron space definition.

Figure 61:
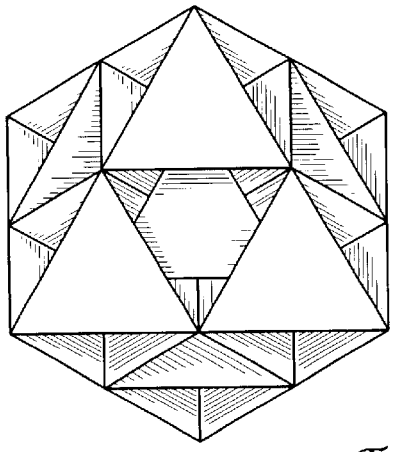
FIG. 61 illustrates a fractalized octahedral assemblage of seven of the first-order octahedral embodiment depicted in FIG. 55.
Figure 62:
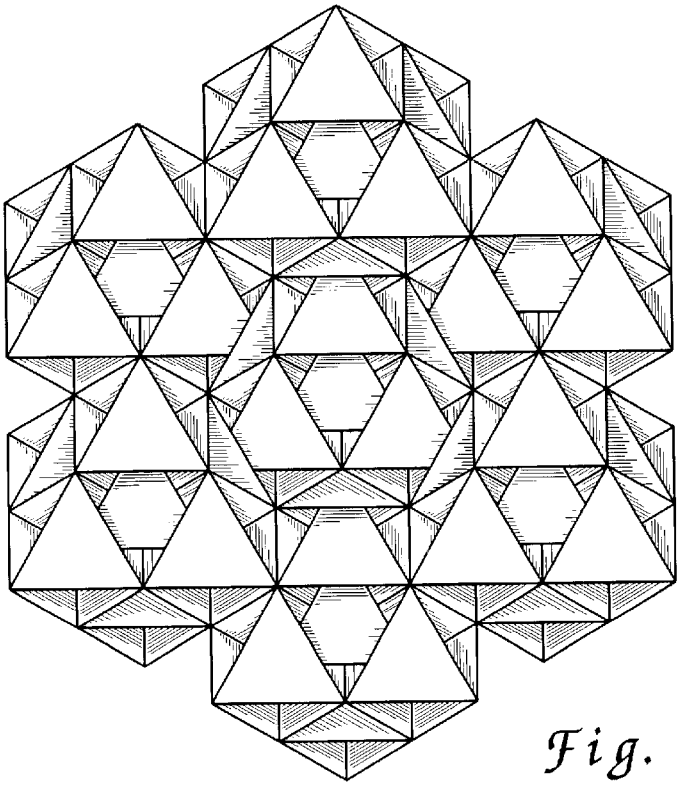
FIG. 62 illustrates a fractalized octahedral assemblage of seven of the seven-element octahedral macro-embodiment depicted in FIG. 61.

FIGS. 61 and 62 depict successively fractalized assemblages of the first-order octahedral embodiment presented in FIG. 55. FIG. 61 is the result of six of these FIG. 55 embodiments being mated with a centering seventh along its six difurcated edge sets. Similarly, the structure of FIG. 62 is formed when six FIG. 61 macro-embodiments are mated with the six exposed edge sets of a seventh FIG. 61 embodiment.

Figure 40:
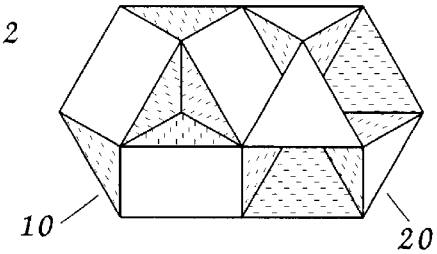
FIG. 40 illustrates a reduced-size perspective view taken from FIG. 1 of structural elements 10 and 20 of the first and second embodiments, respectively, fully mated
Figure 41A:
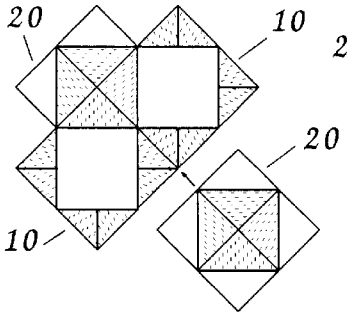
FIG. 41*a* illustrates a plan view of an assembly of three structural elements 10, 20, prior to the addition of a fourth tetrahedral-comprised structural element 20 to the assembly.
Figure 43A:
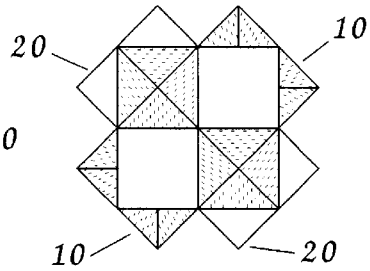
FIG. 43*a* illustrates a plan view of a fourth structural element 20 added to the assembly of FIG. 41*a*.
Figure 42A:
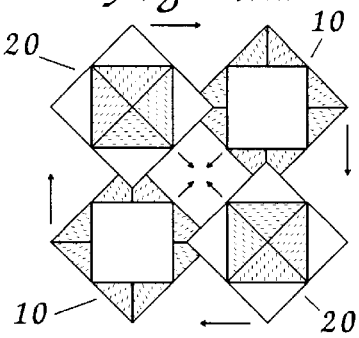
FIG. 42*a* illustrates a plan view of the assembly process for adding an element 20 to the assembly of FIG. 41*a*.
Figure 41B:
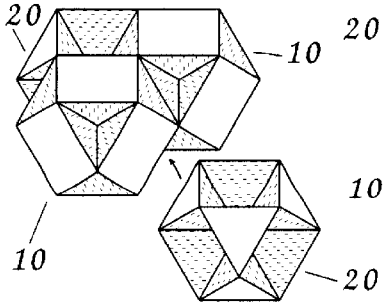
FIG. 41*b* illustrates a perspective view of the assembly and element 20 of FIG. 41*a*.
Figure 43B:
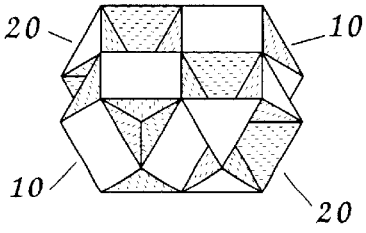
FIG. 43*b* illustrates a perspective view of the assembly of FIG. 43*a*.
Figure 42B:
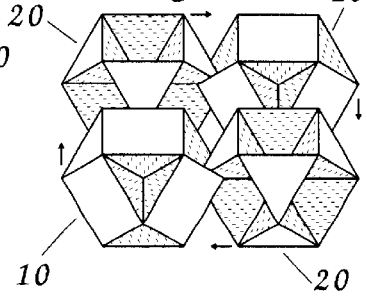
FIG. 42*b* illustrates a perspective view of the assembly method of FIG. 42*a*.

FIG. 63*a* illustrates an embodiment based upon fusing the assembly illustrated in FIG. 40, comprised of a first embodiment element 10 interfitted with a second embodiment element 20, which are fused together to form a single contiguous fused element 130. The fused element 130 includes a combination of a first element 10 and a second element 20, but the voids on the lower portion of fused element 130 are formed as filled-in areas so that element 130 is a contiguous element which still has a number of difurcated edge sets capable of intercleaving with additional elements of the invention, as set forth above. FIG. 63*b* illustrates a reverse-side view of fused element 130 rotated approximately 120 degrees. FIG. 63*c* illustrates a bottom view of fused element 130.

FIGS. 64 thru 67 illustrate additional fused embodiments which may be constructed in accordance with the present invention. FIG. 64 illustrates an embodiment based on a fusing of three first embodiment elements 10 with a single centrally-located second embodiment element 20. FIG. 65 illustrates an embodiment based on the fusing of three second embodiment elements 20 with a single centrally-located first embodiment element 10. FIG. 66 illustrates the embodiment of FIG. 64 with the tetrahedral voids filled in. FIG. 67 illustrates the embodiment of FIG. 65 with the central tetrahedral void filled in. It will be apparent that a variety of other fused elements may also be constructed based on the structural elements of the invention.

In more general discussion, if molded of appropriate materials (including recycled plastics) and in appropriate sizes, various embodiments of the current invention can be used as decorative construction blocks. They can be assembled to function as lawn furnishings, sculptures, climbing structures and play houses, planters and trellises, or as privacy or retaining walls, including unique outdoor staircases which might double as retaining walls.

Their intercleaving nature will make them particularly suitable for constructing large retaining or sea walls. A variety of manufacture and assembly techniques can be employed to create unique wave dampening systems/structures, and artificial reefs. These aquatic uses might be most effective if implemented with elements which are at least partially hollowed and provided with appropriately sized portals to control wave and tidal induced water flows, as well as to function as homes and sheltered hatcheries for small to medium sized aquatic life. Geodic assemblies may be useful not only in such aquatic shelters, but also in industrial settings as containment chambers or bunkers.

Constructed of appropriate materials (steel, aluminum, industrial plastics, epoxy/fiber composites, etc.) and in appropriate sizes, these structures may also function as a connection system for structural members/beams. The structural members (rods, I-beams, trusses, etc.) may be attached to a portion of one or more of the outer surfaces of the structures and/or the structures attached to each end of the members. The members may also be extensions of the outer surface of one or more of the physical or spatial polyhedrons. In the latter case, the beam would extend into and fill the spatial polyhedron and, in effect, be permanently attached. Additional threaded or unthreaded receptacles/openings may also be provided to allow for a more permanent assembly of structures via bolts or rivets, or they may simply be bonded by welds or adhesives. The interfitting nature of these structures will allow the beams to self-align and hold themselves in place while construction crews or do-it-yourselfers complete the assembly and/or the adhesives harden/cure. The manner in which the surfaces of the intercleaving structures interface make these structures particularly effective in amplifying the strength of adhesive bondings.

Rather than having the structural members attached directly to the surfaces of these structures, receptacles may be machined or molded into these surfaces to receive the members. The spatial polyhedrons formed within the basic embodiments may also be used, with or without modifications, as Structural Member receptacles. Manufactured from appropriate materials they may be used for heavy or light weight real-world construction, or in a recreational construction set. In such construction sets, the basic embodiments would not only serve to interconnect the rods, but would also be able to interact with each other.

In any of the aforementioned real construction systems/uses, care must be taken to provide more than adequate webbing, central point, and reinforcement material to insure structural integrity above and beyond the intended use. Although any stipulated use of mortar or other adhesive or connective systems (collectively referred to here as mortared) would greatly increase the strength of assembled structures, there would be, due to their basic nature, a tendency by end users to use such blocks or construction members in a mortarless manner. In such mortarless assemblies, no matter how tightly fitted and mutually supportive the discrete intercleaving components may be, their primary weakness will, of course, lie along their difurcated edge sets. This weakness is further amplified by the relatively high moments of inertia about these edge sets and their coincident central points due to the inverted pyramidal masses of their comprising polyhedral elements, relative to their coincident central points. These inertial moments may be reduced by making the outermost portions of the polyhedral elements hollow or comprised of light weight aggregates, foam or honeycombed structures. In any case, the final design of discrete components should, both individually and in mortared or unmortared compiled assemblies, be as capable or more capable of enduring the abnormal G forces associated with earth tremors, quakes, or abnormal tidal effects, or waves, as any comparable mortared construction system.

Elements of differing sizes may be interconnected to represent different elements in molecular and crystal models, or to simply allow greater artistic and structural variety in general recreational and construction applications. Individual structures, with or without the interfacing features, and simulated or permanently assembled combinations of structures may also be produced as stand-alone decorative and/or functional products. Such products might include nicknacks, paperweights, ash trays, candle holders/lamps, bookends, Christmas tree ornaments, candy dishes, and trinket boxes. Larger items might include coffee and end tables, magazine racks, stools, benches, lamps, and ottomans. Thus, while preferred embodiments have been described herein, it will be recognized that a variety of changes and modifications may be made without departing from the spirit of the subject invention.

What is claimed is:

1. A set of at least two structural elements which may be intercleaved with each other for forming an assembly, said set comprising:

a first structural element having at least two diagonally adjacent first physical polyhedral members and at least two first spatial polyhedral members sharing coincident first edge lines for forming a first edge set;

a second structural element having at least two diagonally adjacent second physical polyhedral members and at least two second spatial polyhedral members sharing coincident second edge lines for forming a second edge set;

wherein said first physical polyhedral members are the same polyhedral shape as said second spatial polyhedral members and said second physical polyhedral members are the same shape as said first spatial polyhedral members, but said first physical polyhedral members are of a different polyhedral shape from said second physical polyhedral members; and wherein at least one of said first edge set and said second edge set includes a cleft whereby said first structural element may be intercleaved to said second structural element by inserting said first physical polyhedral members into the voids formed by said second spatial polyhedral members.

2. The set of claim 1 wherein said first physical polyhedral members are pentahedral square-based pyramids, and wherein said second physical polyhedral members are tetrahedral pyramids.

3. The set of claim 1 wherein said first structural element is formed using six pentahedral pyramids as said first physical polyhedral members, and wherein said second structural element is formed using eight tetrahedral pyramids as said second physical polyhedral members.

4. The set of claim 1 wherein said first physical polyhedral members are arranged within a cuboctahedron space definition, and wherein said second physical polyhedral members are arranged in a complimentary manner within a cuboctahedron space definition.

5. The set of claim 1 wherein said cleft is formed along at least 50 percent of said first edge set and along at least 50 percent of said second edge set.

6. A set of complimentary elements which may be assembled with one-another for forming a structure, said set comprising:

a first element having a plurality of first polyhedron members arranged symmetrically about a central point whereby the edges of said first polyhedron members are aligned with the edges of diagonally adjacent first polyhedron members and connected thereto by a webbing, and wherein a first cleft is formed in a portion of said webbing;

a second element having a plurality of second polyhedron members arranged symmetrically about a central point whereby the edges of said second polyhedron members are aligned with the edges of diagonally adjacent second polyhedron members and connected thereto by a webbing, and wherein a second cleft is formed along a portion of said webbing;

whereby said first element has voids in the shape of said second polyhedron members, which accommodate portions of said second element, and said second element has voids in the shape of said first polyhedron members which accommodate portions of said first element when said first element is assembled to said second element by inserting the webbing of said first element into said second cleft of said second element and the webbing of the second element into said first cleft of the first element for assembling the first element to the second element.

7. The set of claim 6 wherein said first polyhedron members are pentahedral square-based pyramids, and wherein said second polyhedron members are tetrahedral pyramids.

8. The set of claim 6 further including a third element having a combination of said first polyhedron members on one half thereof and said second polyhedron members on the other half thereof for assembly to either of said first elements or said second elements.

9. The set of claim 6 wherein said first element is formed using six pentahedral pyramids as said first polyhedron members, and wherein said second element is formed using eight tetrahedral pyramids as said second polyhedron members.

10. The set of claim 6 wherein said first polyhedron members are arranged within a cuboctahedron space definition, and wherein said second polyhedron members are arranged in a complementary manner within a cuboctahedron space definition.

11. A set of structural elements capable of assembly by interfitting with each other, said set comprising:

at least one first element, said first element being composed of six equilateral square based pyramids having their apexes located at a single central point, and an having their edges aligned with the edges of diagonally adjacent said square-based pyramids, with clefts located along the outer portions of said aligned edges;

at least one second element, said second element being composed of eight equilateral tetrahedral pyramids having their apexes located at a single central point, and having their edges aligned with the edges of diagonally adjacent said tetrahedral pyramids, with clefts located along the outer portions of said aligned edges; and whereby said clefts permit portions of said square based pyramids to be inserted into spaces between said tetrahedral pyramids, while portions of said tetrahedral pyramids may be simultaneously inserted into spaces between said square-based pyramids for intermitting said first element with said second element.

12. The set of claim 11 wherein said square-based pyramids of said first elements are arranged to correspond with the square surfaces of a cuboctahedral space definition, and wherein said tetrahedral pyramids of said second element are arranged to correspond with the triangular surfaces of a cuboctahedral space definition.

13. The set of claim 11 wherein a third element is included, said third element having one half that is comprised of three pentahedral square-based pyramids and an another half that is comprised of four tetrahedral pyramids arranged around a central point, whereby said third element can intercleave with either said first element or said second element.

14. The set of claim 11 wherein webbing is included along said aligned edges of said square-based pyramids and said aligned edges of said tetrahedral pyramids for maintaining the structural integrity of said first element and said second element, respectively.

15. A system for assembling a structure of multiple intercleaving elements, said system comprising:

providing a first element, said first element including a plurality of first polyhedral members, said first polyhedral members being clustered about at least one first central point in an edge-aligned fashion so that first voids are located on both sides of any two diagonally adjacent polyhedral members whereby the coincident aligned edges of said first polyhedral members create first edge sets, and further whereby a cleft is provided along a portion of at least one said first edge sets;

providing a second element including a plurality of second polyhedral members, said second polyhedral members being of a shape different from said first polyhedral members, said second polyhedral members being clustered about at least one second central point in an edge-aligned fashion whereby the coincident aligned edges of said second polyhedral members create second edge sets, and further whereby a cleft is provided along a portion of at least one said second edge sets, and second voids are located on either side of any two diagonally adjacent said second polyhedral members, whereby, said second element may be assembled to said first element by inserting portions of said first polyhedral members into said second voids, and said second polyhedral members into said first voids by sliding together along said first and second edge sets.

16. The system of claim 15 wherein said first polyhedral members are pentahedral square-based pyramids, and wherein said second polyhedral members are tetrahedral pyramids.

17. The system of claim 15 further including providing a third element having a combination of said first polyhedral members on one half thereof and said second polyhedral members on the other half thereof for assembly to either of said first elements or said second elements.

18. The system of claim 15 wherein said first element is formed having six square-based pentahedral pyramids as said first polyhedral members arranged in a spherically symmetrical pattern about said first central point, and wherein said second element is formed having eight tetrahedral pyramids as said second polyhedral members arranged in a spherically symmetrical pattern about said second central point.

19. The system of claim 15 wherein said first polyhedral members are arranged within a cuboctahedron space definition, and wherein said second polyhedral members are arranged in a complementary manner within a cuboctahedron space definition.

20. The system of claim 15 wherein said first voids are the same shape as said second polyhedral members, and said second voids are the same shape as said first polyhedral members.

* * * * *